US012065275B2

(12) United States Patent
Wintz et al.

(10) Patent No.: US 12,065,275 B2
(45) Date of Patent: Aug. 20, 2024

(54) BIB TIE AUTOMATION SYSTEM

(71) Applicant: Bedford Industries, Inc., Worthington, MN (US)

(72) Inventors: Trevor Wintz, Round Lake, MN (US); Jaden Balster, Adrian, MN (US); Troy Lang, Fulda, MN (US)

(73) Assignee: Bedford Industries, Inc., Worthington, MN (US)

( * ) Notice: Subject to any disclaimer, the term of this patent is extended or adjusted under 35 U.S.C. 154(b) by 0 days.

(21) Appl. No.: 18/164,667

(22) Filed: Feb. 6, 2023

(65) Prior Publication Data

US 2023/0249856 A1 Aug. 10, 2023

Related U.S. Application Data

(60) Provisional application No. 63/417,652, filed on Oct. 19, 2022, provisional application No. 63/308,694, filed on Feb. 10, 2022.

(51) Int. Cl.

| | |
|---|---|
| ***B65B 51/08*** | (2006.01) |
| ***B65B 13/18*** | (2006.01) |
| ***B65B 41/16*** | (2006.01) |

(52) U.S. Cl.

CPC ..... *B65B 13/182* (2013.01); *B65B 13/186* (2013.01); *B65B 41/16* (2013.01); *B65B 51/08* (2013.01)

(58) Field of Classification Search

CPC ..... B65B 51/08; B65B 13/186; B65B 13/182; B65B 41/16

See application file for complete search history.

(56) References Cited

U.S. PATENT DOCUMENTS 2,961,930 A 11/1960 Wamsley et al.
3,083,512 A 4/1963 Hilton
(Continued)

FOREIGN PATENT DOCUMENTS

WO 2008047922 A1 4/2008
WO 2008120758 A1 10/2008
(Continued)

OTHER PUBLICATIONS

Bedford Industries, Inc. "Bedford Ring Tyer," publicly available at least as of Aug. 23, 2021 (75 pages).
(Continued)

*Primary Examiner* — Andrew M Tecco
(74) *Attorney, Agent, or Firm* — Mai D. Lauer; Westman, Champlin & Koehler P.A.

(57) ABSTRACT

A system is configured to automatically band a product with a portion of twist tie material and includes a tying machine which includes a twisting barrel, a tie payout assembly, a tie feeding assembly, a main drive belt, and a tying ring. The tie payout assembly includes a spool shaft configured for mounting a tie spool of the twist tie material. The tie feeding assembly is configured to receive the twist tie material from the tie payout assembly and includes a feedroller, a nip roller, a forward feedroll clutch, a reverse feedroll clutch, and a feedroll belt. The nip roller is configured to contact the feedroller with the twist tie material therebetween. The forward feedroll clutch is engageable with a forward feedroll pulley that surrounds a forward feedroll shaft. The reverse feedroll clutch is engageable with a reverse feedroll pulley that surrounds a reverse feedroll shaft.

10 Claims, 31 Drawing Sheets

(56) References Cited

U.S. PATENT DOCUMENTS

| | | | | | |
|---|---|---|---|---|---|
| 3,146,695 | A * | 9/1964 | Van De Bilt | B65B 13/02 | 100/32 |
| 3,147,673 | A | 9/1964 | Hilton | | |
| 3,318,230 | A | 5/1967 | Hilton | | |
| 3,344,740 | A | 10/1967 | Hilton | | |
| 3,354,915 | A | 11/1967 | Johnson et al. | | |
| 3,370,328 | A | 2/1968 | Hilton | | |
| 3,375,634 | A | 4/1968 | Jarund | | |
| 3,398,502 | A | 8/1968 | Halstead | | |
| 3,426,393 | A | 2/1969 | Mead | | |
| 4,313,779 | A * | 2/1982 | Nix | B65B 13/327 | 156/515 |
| 4,711,064 | A | 12/1987 | Tsuda | | |
| 4,730,434 | A * | 3/1988 | Knudsen | B65B 51/08 | 53/138.8 |
| 4,856,258 | A * | 8/1989 | Burford | B65B 51/08 | 53/138.8 |
| 4,907,392 | A * | 3/1990 | Knudsen | B65B 51/08 | 83/578 |
| 5,732,495 | A | 3/1998 | Lowe et al. | | |
| 5,771,664 | A | 6/1998 | Recchia, Jr. | | |
| 6,601,366 | B1 | 8/2003 | Grutter | | |
| 6,928,788 | B1 * | 8/2005 | Lai | B65B 51/08 | 53/138.8 |
| 10,726,747 | B2 | 7/2020 | Navarro | | |
| 2010/0088939 | A1 | 4/2010 | Maniwa | | |

FOREIGN PATENT DOCUMENTS

| | | | |
|---|---|---|---|
| WO | 2008120760 | A1 | 10/2008 |
| WO | 2010001345 | A2 | 1/2010 |
| WO | 2023004232 | A2 | 1/2023 |

OTHER PUBLICATIONS

International Search Report mailed Aug. 10, 2023, for corresponding International application No. PCT/US2023/061799.
Written Opinion mailed Aug. 10, 2023 for corresponding International application No. PCT/US2023/061799.

* cited by examiner

BIB TIE AUTOMATION SYSTEM

CROSS-REFERENCE TO RELATED APPLICATIONS

This application claims the benefit of priority from U.S. Provisional Patent Application No. 63/308,694 filed Feb. 10, 2022, and this application claims the benefit of priority from U.S. Provisional Patent Application No. 63/417,652 filed Oct. 19, 2022; the contents of these priority applications is hereby incorporated by reference in their entireties.

BACKGROUND

Merchandise of many different types is banded in one way or another for packaging or preparing the merchandise for movement in channels toward the ultimate presentation and marketing to the consumer. For example, a twist tie may be placed about the mouth of a bag or about a container of merchandise or about multiple containers. The twist tie may also be placed directly around the merchandise itself, such as to bundle a grouping of agricultural produce or around a single item of merchandise (for example, a rolled or folded newspaper or coiled hose or cable).

Labeling or marking of merchandise with printed matter is also often desirable to provide information to various entities in the production and marketing channels as well as to the ultimate consumer. The printed matter may provide information regarding merchandise identification and price and may take the form of, for example, machine readable or scannable material (such as codes comprised of bars or characters or other markings) and human readable material (such as characters and graphical or pictorial matter). In modern mass merchandising outlets such as discount stores or supermarkets, there has been an almost complete movement toward labeling products (or the packaging thereof) with an identification code, such as a Universal Product Code (UPC) or Quick Response (QR) Code, which includes a bar or graphical code readable by an electronic scanner, smart phone, or other device.

Additionally, other printed matter (besides the UPC bar code) may also be associated with the merchandise items. For example, in the particular case of agricultural produce, a "Product Look Up" (PLU) number identification code, a trademark of the producer and a collective or certification mark may also be displayed. Inclusion of storage directions, serving suggestions and recipes for preparing the particular item may promote sales of the product. Moreover, a table of "Nutritional Facts" and an indication of the place of origin (such as country or state) may be required by law to be marked on the produce.

However, banding and tagging merchandise in a quick, efficient, simple, secure and reliable manner has been an elusive goal. Banding and tagging difficulties have been most serious in the production and marketing of agricultural produce, where problems can arise both during and after the banding and tagging operation is performed; moreover, handling of the produce is further complicated because of its non-uniform nature and configuration.

Bands and tags applied in the agricultural field are subjected to the rigors of a variety of produce processing operations and should remain intact and securely in place on the produce throughout processing, sales display, and scanning at the supermarket checkout counter. Produce processing often includes washing the produce (such as with a high velocity water blast), chilling the produce by dumping ice thereon and/or submersion of the produce in chilled water, and moving the produce (such as by conveyors). Once the produce reaches the supermarket display case, it is unpacked and then often subjected to repeated sprayings with water. After all that handling and processing, the produce must then be displayed in a way that presents an attractive product for consumer selection and purchase (and preferably, appropriately tagged for check-out).

Tags that succumb to the produce processing operations by becoming detached from the twist tie or by appearing excessively worn or tattered are likely to cause rejection of the produce by the grocer and the consumer. Produce buying is generally considered to be highly dependent upon the presentation of a pleasing product appearance to the consumer, and if the condition of a tag on produce appears unattractive, a consumer may be less inclined to buy the produce. As a result, grocers may be less inclined to purchase and display produce with a tag having an unsightly appearance. In a more practical sense, the tag should remain attached to the produce and readable by a checkout scanner until the time of supermarket checkout, and grocers may refuse produce shipments having a significant number of tags missing or in an unscannable condition. Thus, it is desirable to simplify and speed up the banding and tagging of merchandise such as produce with durable tag materials.

SUMMARY

In one aspect, a system is configured to automatically band a product with a portion of twist tie material. The system comprises a tying machine which comprises a twisting barrel, a tie payout assembly, a tie feeding assembly, a main drive belt, and a tying ring. The tie payout assembly comprises a spool shaft configured for mounting a tie spool of the twist tie material. The tie feeding assembly is configured to receive the twist tie material from the tie payout assembly and comprises a feedroller, a nip roller, a forward feedroll clutch, a reverse feedroll clutch, and a feedroll belt. The nip roller is configured to contact the feedroller with the twist tie material therebetween. The forward feedroll clutch is engageable with a forward feedroll pulley that surrounds a forward feedroll shaft. The reverse feedroll clutch is engageable with a reverse feedroll pulley that surrounds a reverse feedroll shaft. The feedroll belt is operatively connected to the forward feedroll pulley and the reverse feedroll pulley. Engagement of the forward feedroll clutch rotates the feedroller forward to move the twist tie material toward a tying ring, and engagement of the reverse feedroll clutch rotates the feedroller backward to move the twist tie material toward the tie spool. The main drive belt is driven by a main drive pulley around the forward feedroll shaft and the reverse feedroll shaft. The tying ring comprises a channel configured to convey the twist tie material from the twisting barrel, and back to the twisting barrel, thereby encircling the product.

In another aspect, an apparatus comprises a dump tray, a plurality of packing fingers, and an actuator. The dump tray comprises a plurality of dump fingers. Each packing finger is disposed between two adjacent dump fingers of the plurality of dump fingers. The actuator is configured for selective extension between a retracted configuration, an intermediate configuration, and an extended configuration. In the retracted configuration, the dump tray is raised. In the intermediate configuration, the dump tray and the plurality of packing fingers are aligned substantially horizontally. In the extended configuration, the plurality of packing fingers are raised.

This summary is provided to introduce concepts in simplified form that are further described below in the Detailed Description. This summary is not intended to identify key features or essential features of the disclosed or claimed subject matter and is not intended to describe each disclosed embodiment or every implementation of the disclosed or claimed subject matter. Specifically, features disclosed herein with respect to one embodiment may be equally applicable to another. Further, this summary is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure or system elements are referred to by like reference numerals throughout the several views. It is contemplated that all descriptions are applicable to like and analogous structures throughout the several embodiments.

While the above-identified figures set forth several embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art that fall within the scope of the principles of this disclosure.

The figures may not be drawn to scale. In particular, some features may be enlarged relative to other features for clarity. Moreover, where terms such as above, below, over, under, top, bottom, side, right, left, vertical, horizontal, etc., are used, it is to be understood that they are used only for ease of understanding the description. It is contemplated that structures may be oriented otherwise. Like reference numbers are used for analogous structures (such as 36 and 36' for different implementations of a product, for example). It is to be understood that descriptions of structures also apply to analogous structures unless otherwise indicated.

DETAILED DESCRIPTION

This disclosure relates generally to equipment to automate the attachment of a labeling and banding article on a merchandise product, and particularly for simultaneously banding and tagging of the merchandise. In exemplary embodiments, the equipment positions and places a twist tie (having a tag thereon for bearing printed matter) securely about a portion of the product. The economical tag-bearing tie article is easily and quickly applied to merchandise using the disclosed automation equipment. Automation in produce packaging simplifies the motions human workers use, thereby increasing the overall output rate of packaging and decreasing the incidence of repetitive use injuries. The tag-bearing tie article is durable enough to remain intact and securely attached to merchandise and not be smeared or defaced during its movement through production and marketing channels.

Figure 1A:
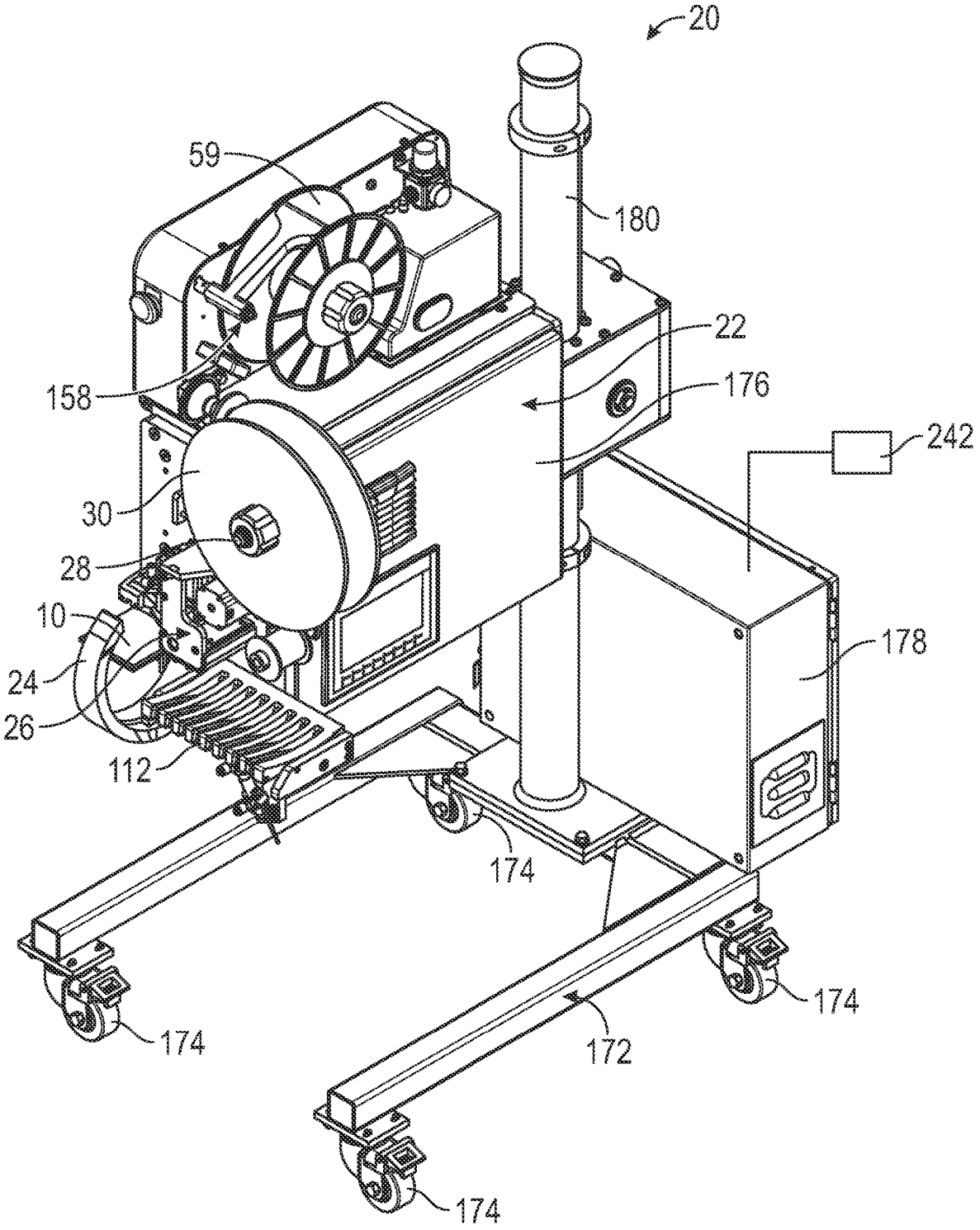
FIG. 1A is a front right perspective view of an exemplary system for automatically attaching a labeling article to a product.
Figure 1B:
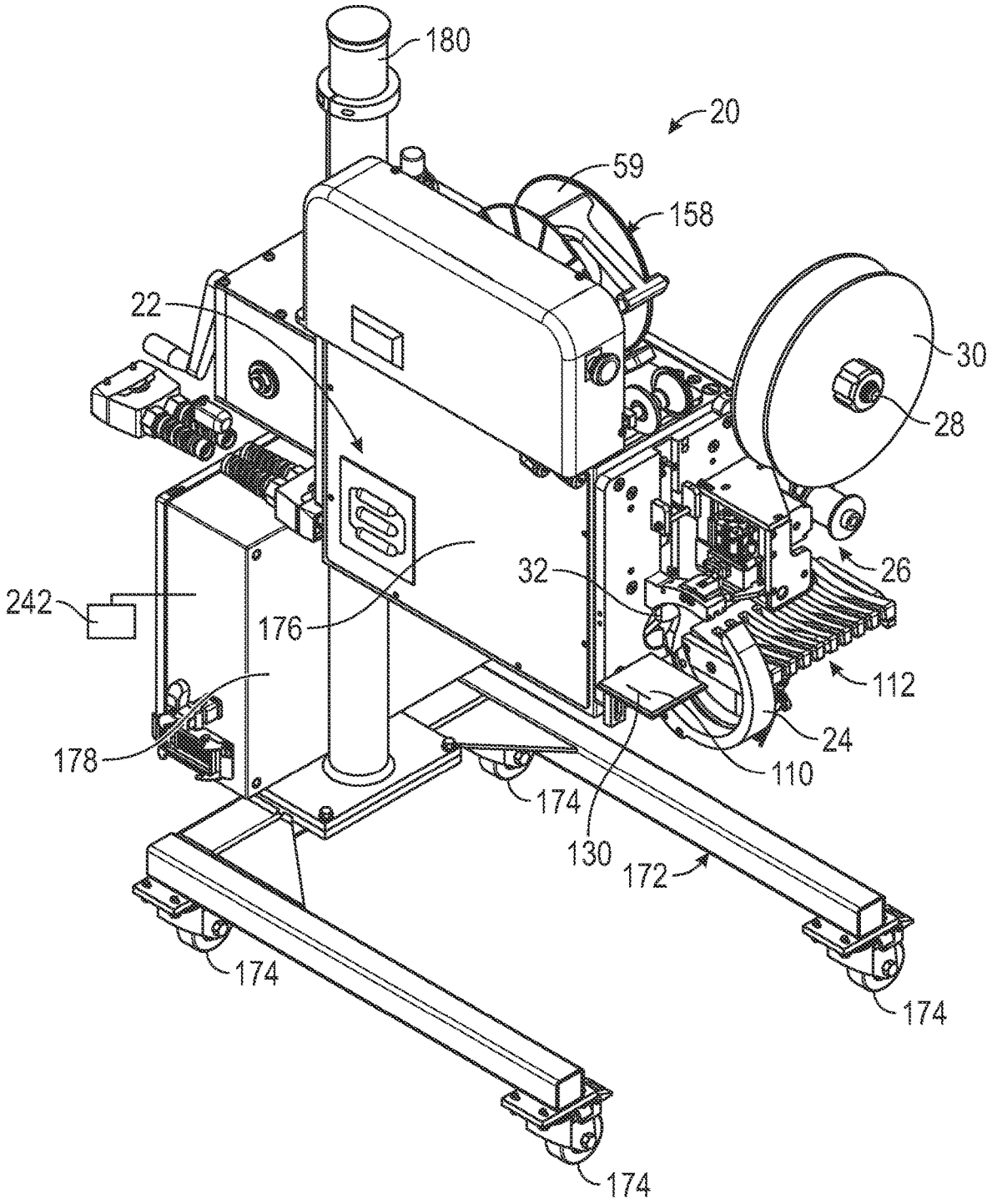
FIG. 1B is a left front perspective view of the exemplary system.
Figure 1C:
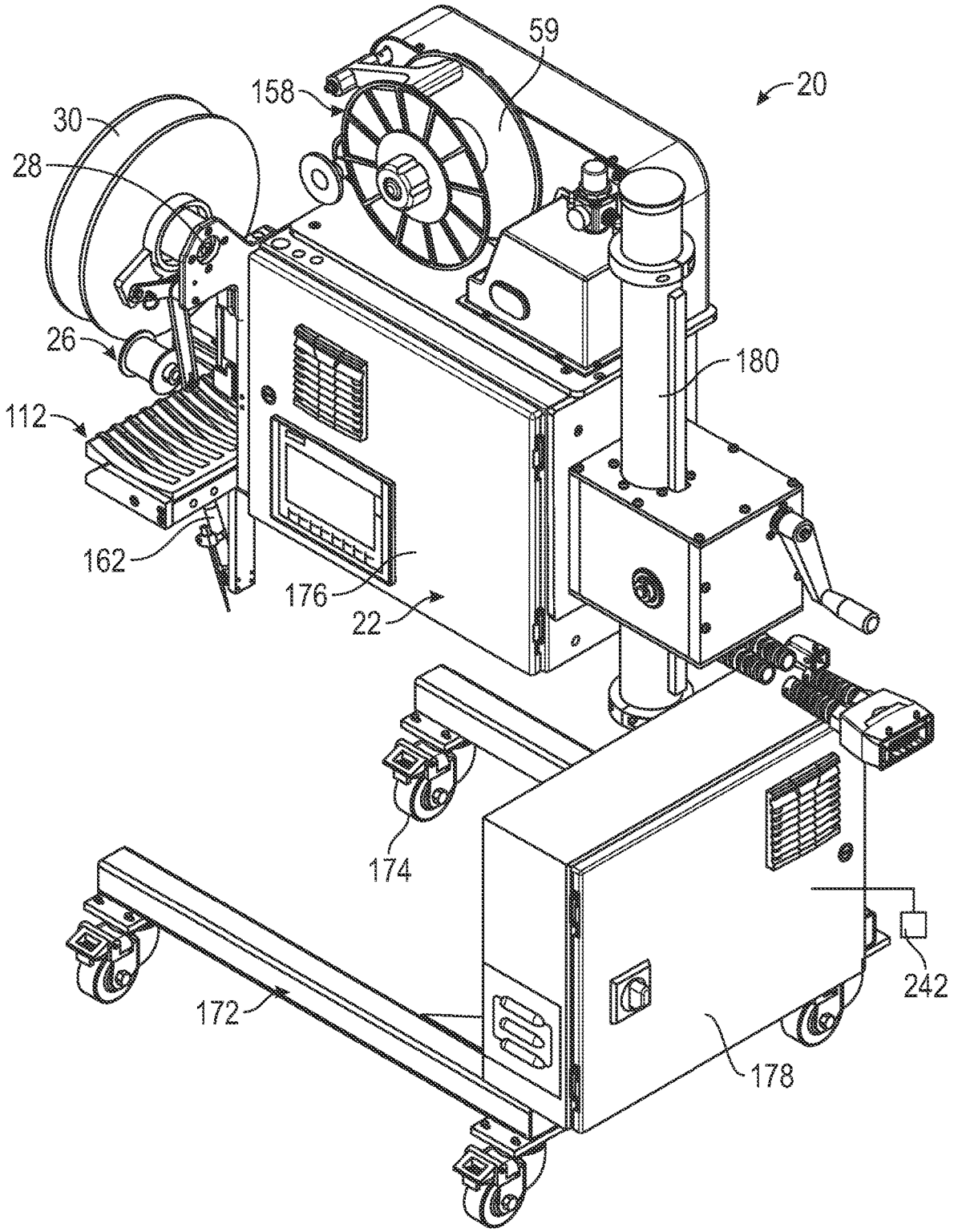
FIG. 1C is a right rear perspective view of the exemplary system.

FIGS. 1A, 1B and 1C are perspective views of an exemplary system 20 for automatically attaching a labeling article to a product. System 20 is configured for automating the attachment of a labeling and banding article 84 (shown in FIGS. 5, 6A, 8 and 9, also referred to as twist tie article 84) on a merchandise product 36. System 20 in an exemplary embodiment uses tying machine 22 with one or more of a tag feeding assembly 26, tag supply support 28, tie payout assembly 158, tying ring 24, product shelf 110 and/or dump table 112.

In an exemplary embodiment, tying machine 22 is provided on a mobile frame 172, such as one supported for motion on a ground surface by casters 174. In an exemplary embodiment, the components of tying machine 22 are separated into a mechanical cabinet 176 and an electrical cabinet 178. As will be explained further below, tying machine 22 may be used in an environment exposed to weather, dirt and debris. By separating the electrical components and housing them in a separate electrical cabinet 178 that can be physically distanced from the tying and tagging operation near ring 24, the front components that may soil most easily can be washed while the electrical components are shielded from water and other cleaning agents. Electrical, pneumatic and other lines, though not illustrated, operatively connect the components of the cabinets 176, 178. In an exemplary embodiment, mechanical cabinet 176 and components attached thereto are adjustably supported on post 180 to allow a user to change a height of the mechanical cabinet 176 relative to a ground surface. In an exemplary embodiment, a programmable logic controller 242 is housed in electrical cabinet 178 and automatically controls and coordinates features of system 20 discussed below, for example, tag feeding and separation, twist tie payout and feeding (including forward and reverse motions of the twist tie), opening and closing of tying ring 24, tie cutting and twisting, and raising and lowering of the packing fingers and tray of the dump table, for example.

In some instances, items may have different configurations. For example, a product to be labeled and banded by system 20 is referred to generally as product 36. FIGS. 2A-6B and 8 show one embodiment of a product as a lettuce head, given the reference number 36. However, there are many suitable configurations for a product usable with system 20, including without limitation the wrapping and labeling of produce (bundles of carrots, leafy produce, asparagus or floral bouquets, for example), the wrapping and labeling of coiled products (for example, garden hoses, cables and jumping ropes), and the bundling and labeling of industrial products (for example, lengths of pipe, other elongated members such as rebar or threaded rods, and larger bolts and other fasteners). Moreover, as shown in FIGS. 7A-7E, tags 42, 42*a* and 42*b* may have different dimensions and hole configurations. It is to be understood that all discussions relevant to a part also apply to analogous parts, such as those similarly numbered.

Figure 2A:
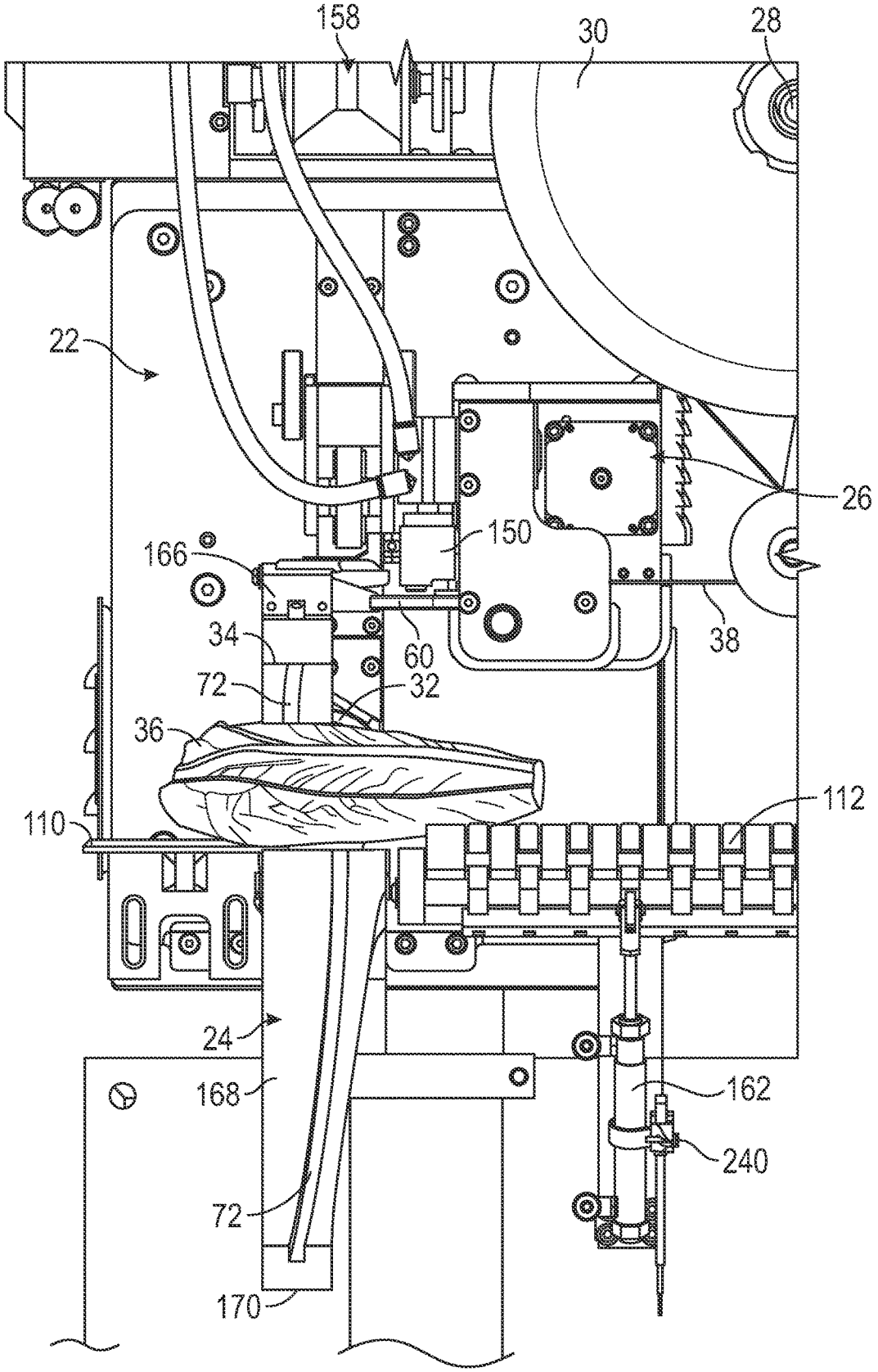
FIG. 2A is a perspective view of a portion of a tying machine, wherein a merchandise product is inserted into an open ring of the machine and positioned to span a product shelf and dump table.
Figure 2B:
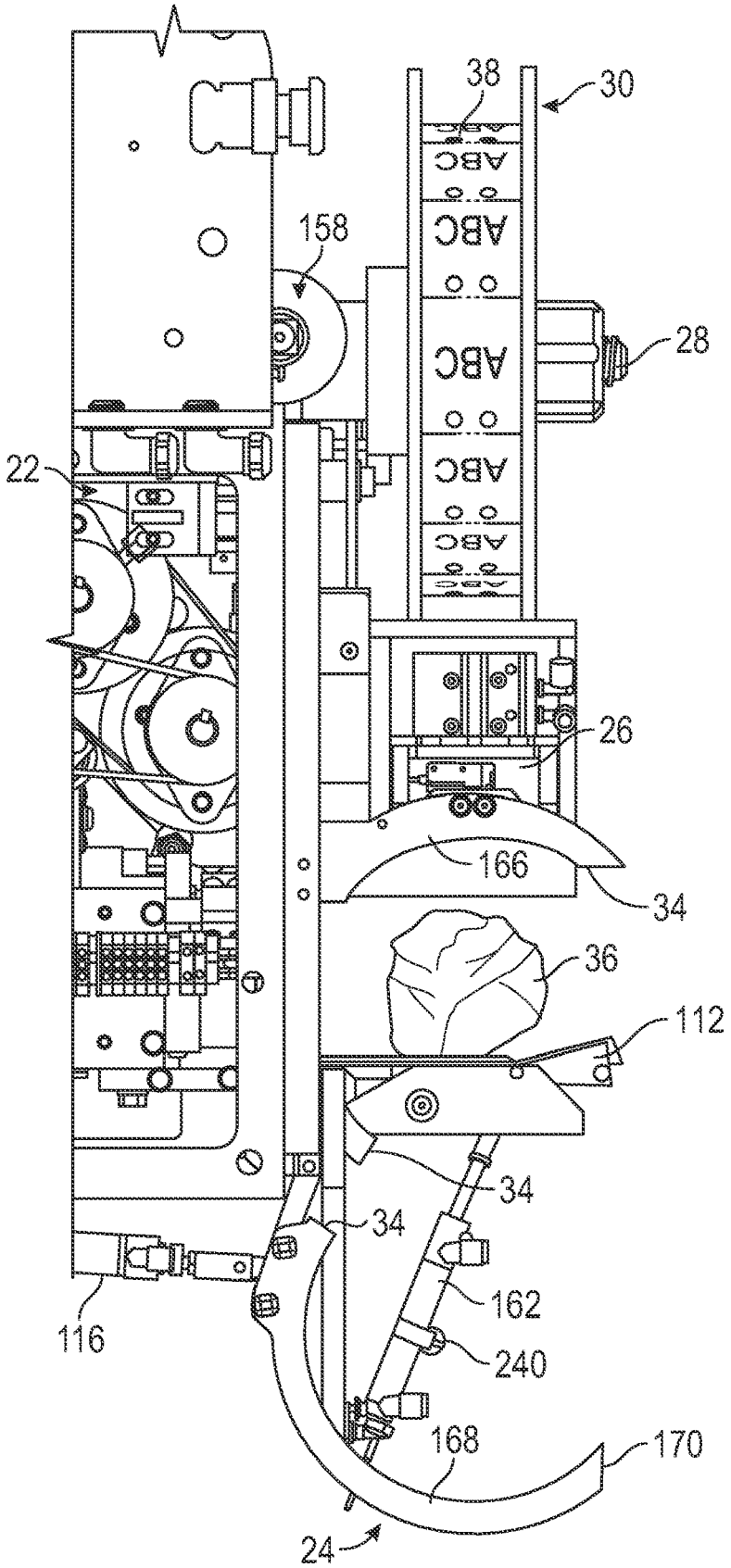
FIG. 2B is a side view of the system of FIG. 2A.
Figure 3:
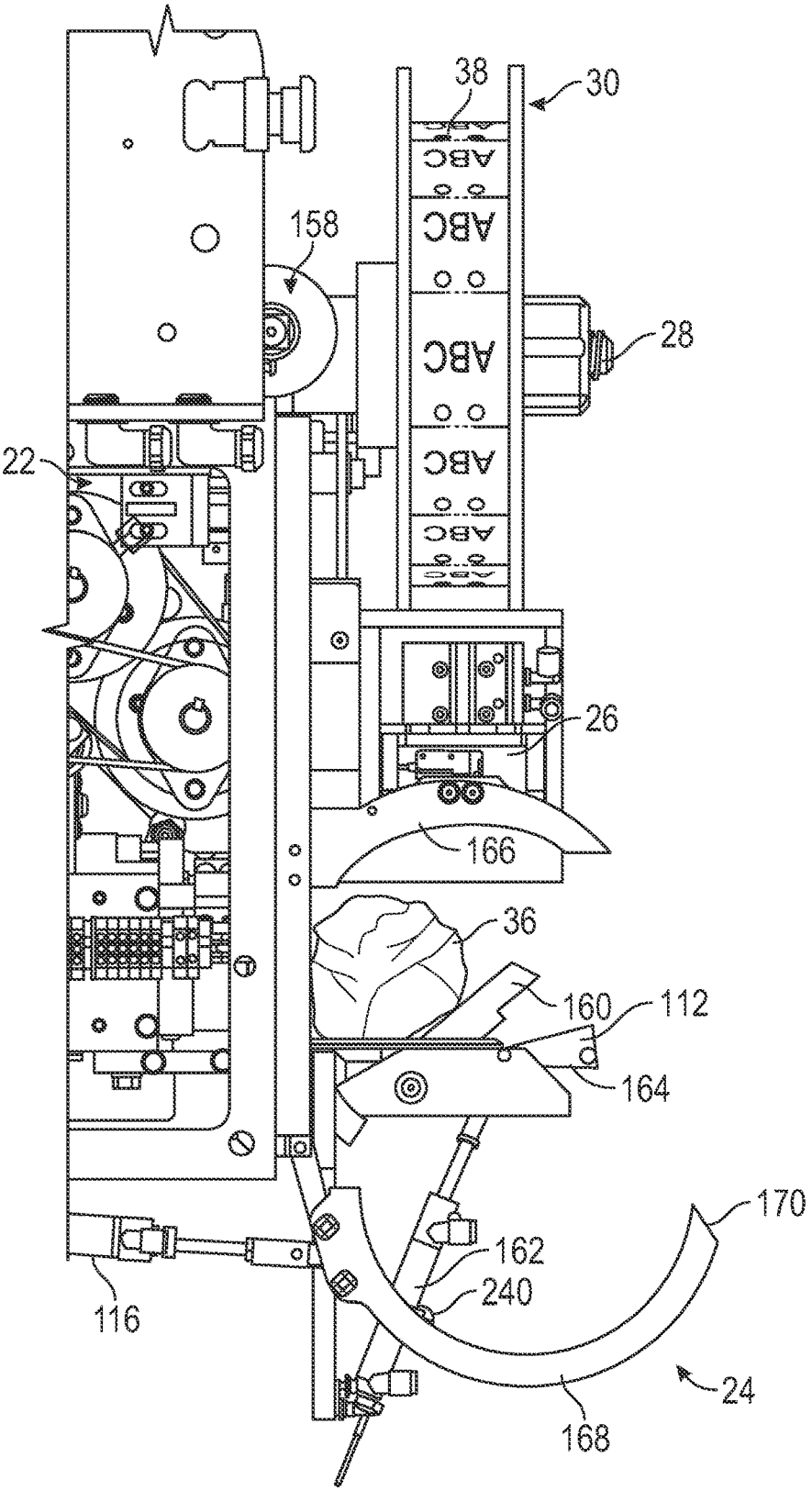
FIG. 3 is similar to FIG. 2B but shows dump table fingers in the gathering (up) position and partial extension of a closing cylinder of the ring.
Figure 4:
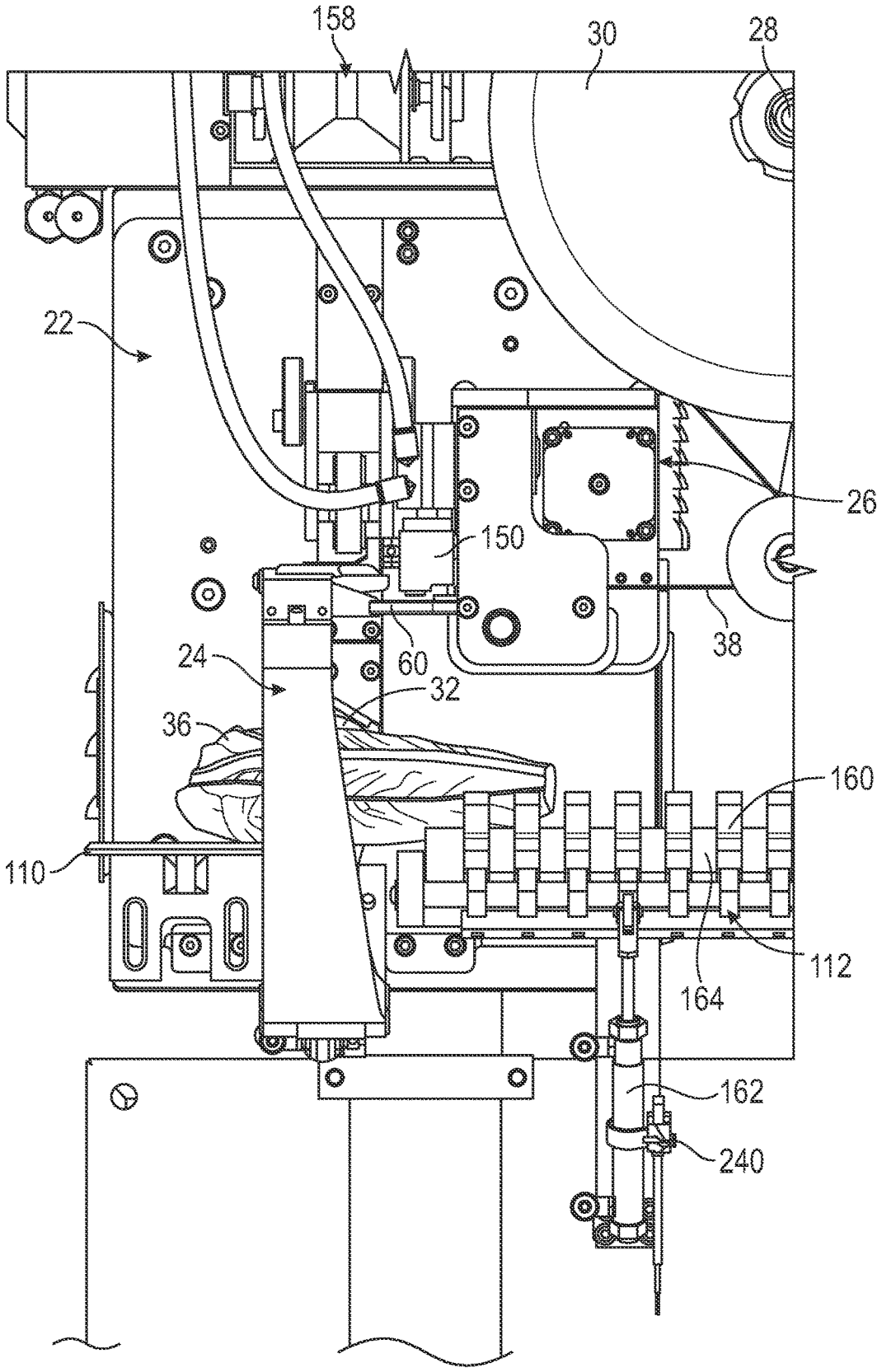
FIG. 4 is similar to FIG. 2A but shows the ring closed around the product and packing fingers of the dump table raised to push the product toward the tying mechanism.
Figure 11B:
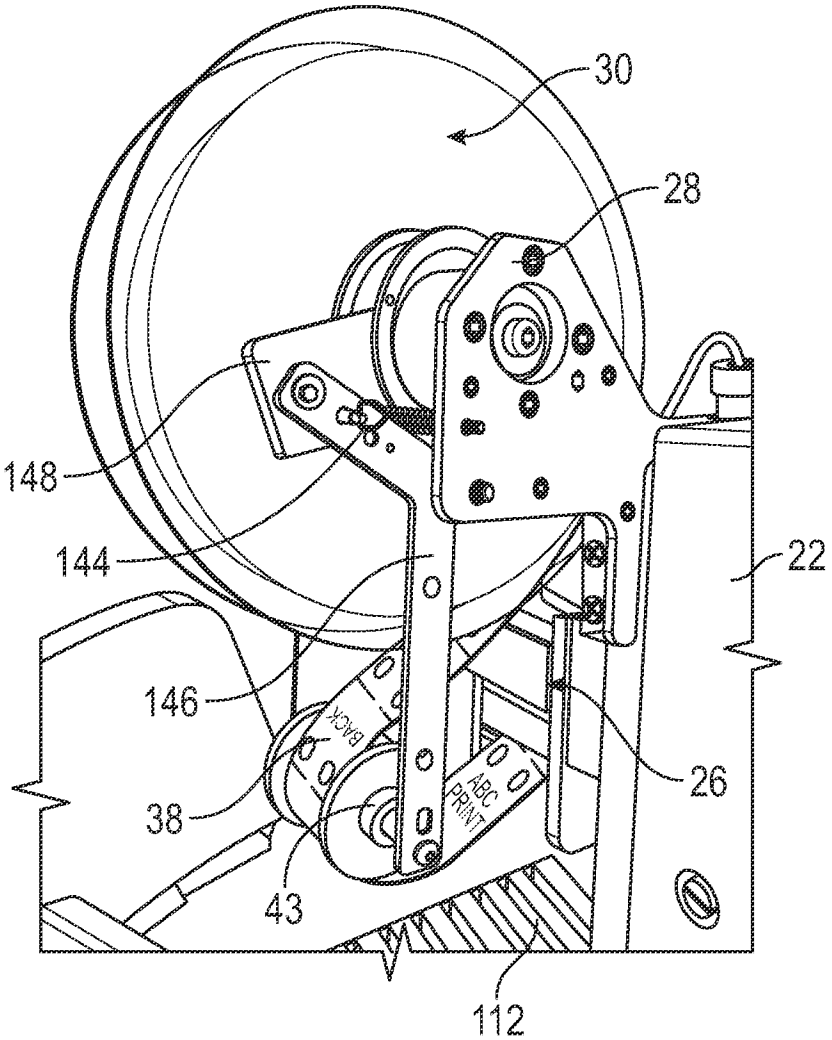
FIG. 11B is a rear perspective view of the tag spool.
Figure 11A:
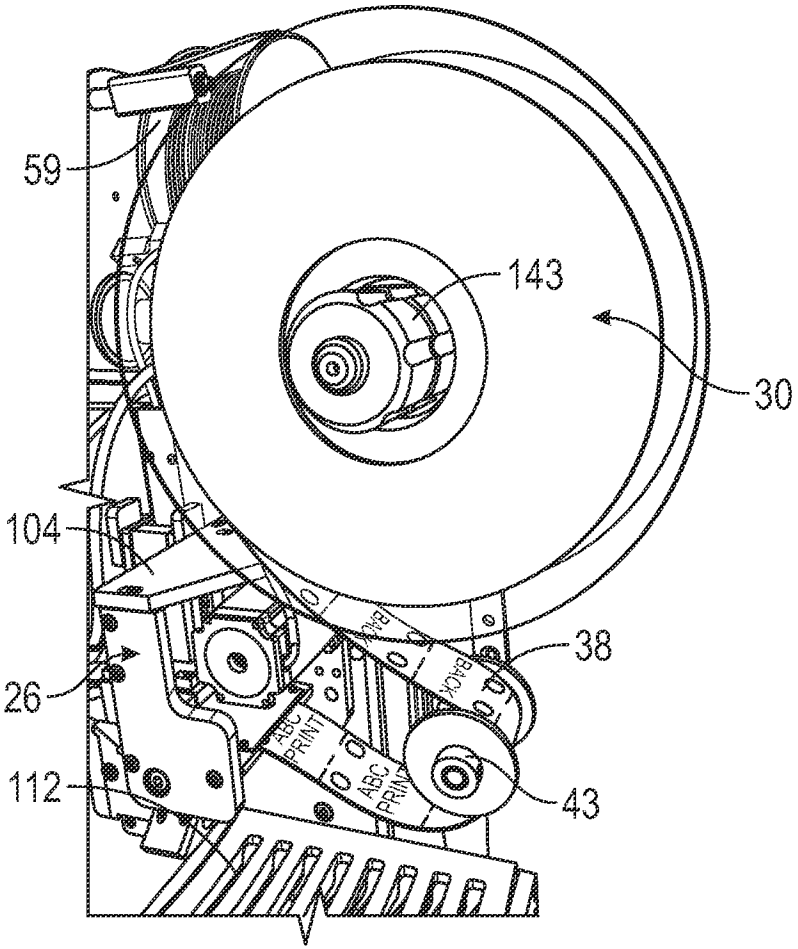
FIG. 11A is a front perspective view of a tag spool of the system.

In an exemplary embodiment of an automated product banding and tagging operation, a user places product 36 on product shelf 110 and dump table 112, as shown in FIGS. 2A and 2B. A clearance gap between the product shelf 110 and dump table 112 allows ring 24 to close and open between them, as shown in FIGS. 3 and 4. As shown in FIGS. 11A and 11B, a strip 38 of ruptureably joined tags 42 is pulled from spool 30 to tag feeding assembly 26.

As shown in FIGS. 3, 4, once tag 42 is fully inserted into tag receiving portion 40 of ring 24, an actuator 116 (shown in FIG. 14B) closes ring 24 to form a continuous twist tie travel channel 72 (see FIG. 13A, for example) on an interior surface of the ring 24. Simultaneously, packing fingers 160 of dump table 112 pivot upward to gather the product and push it toward twist barrel 32 (see FIGS. 4, 15A and 15B). Twist tie material is fed from spool 59, through twist barrel 32, along channel 72, through apertures 48 of the inserted tag 42, and back to twist barrel 32. Tie feeding is reversed to cinch the twist tie 58 around the product 36. A knife within the twist barrel 32 cuts the twist tie 58, and grippers twist free ends of the twist tie 58 to form twisted closure 86, thereby securing labeling article 84 to the product 36. (see FIGS. 5-6B and 8).

Figure 5:
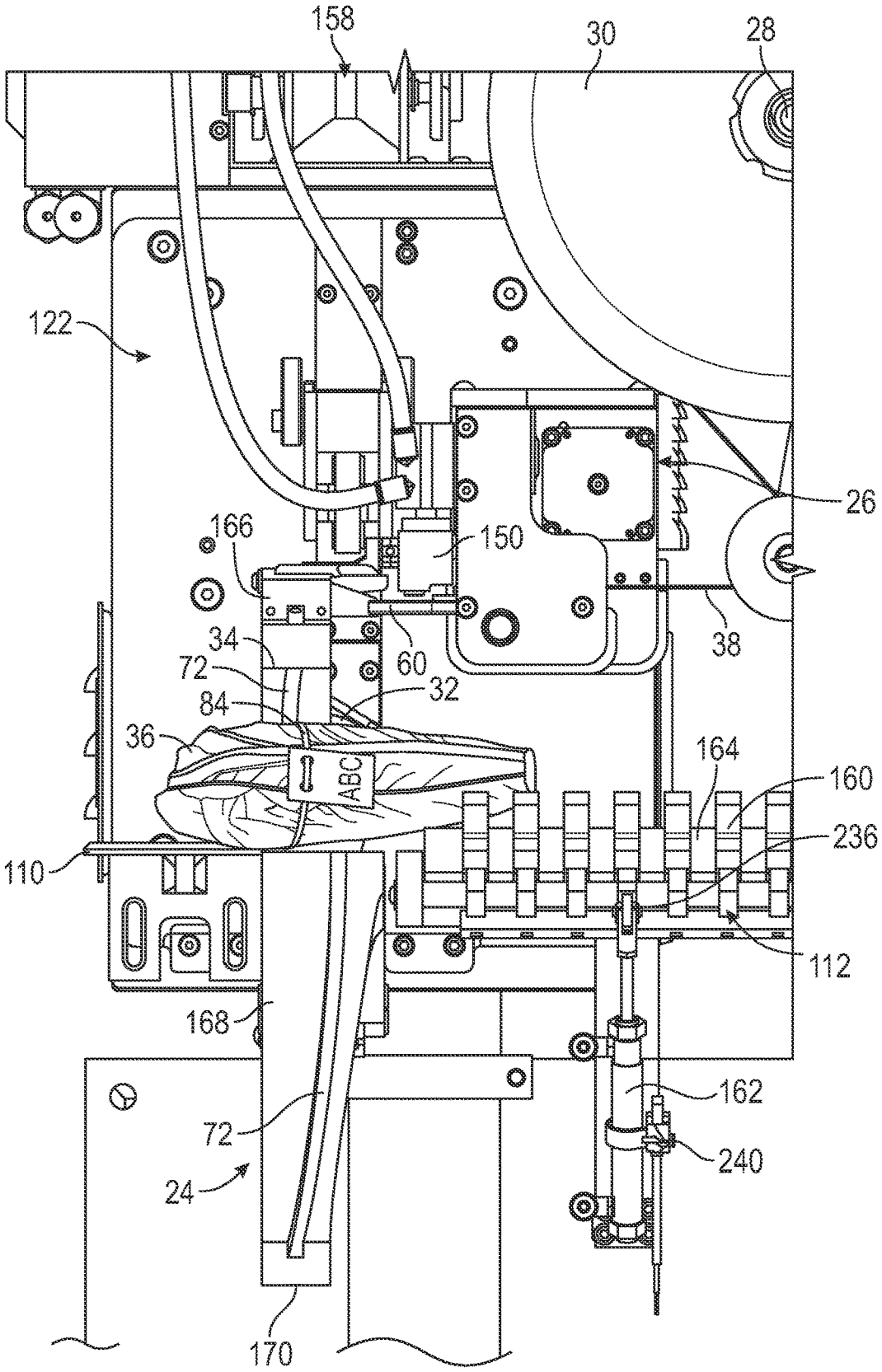
FIG. 5 is similar to FIG. 4 but shows the product after tagging and tying, and with the ring open for product release.
Figure 6A:
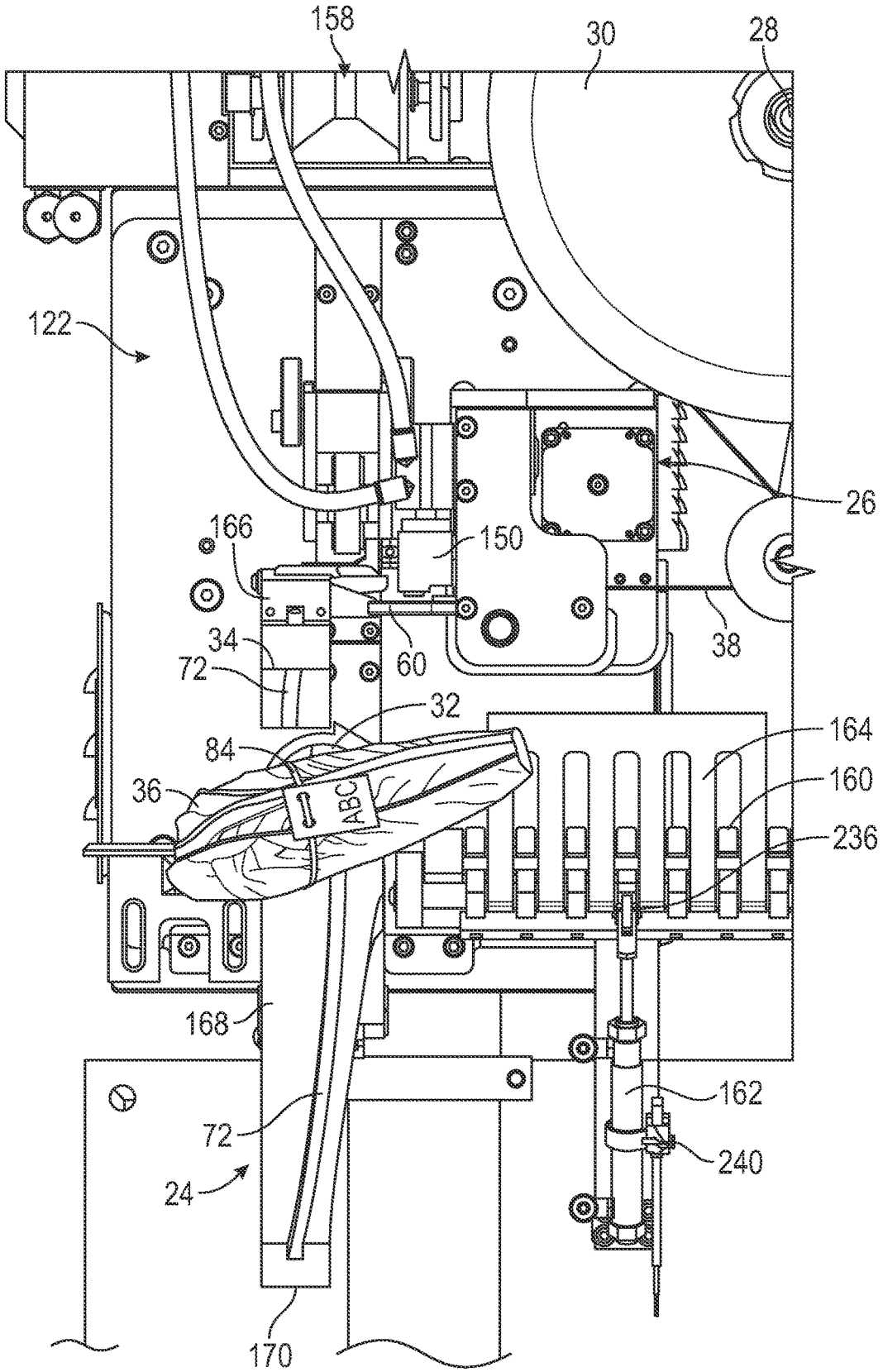
FIG. 6A is similar to FIG. 4 but shows the tray of the dump table raised to allow the tagged and tied product to fall by gravity out of the open ring.
Figure 6B:
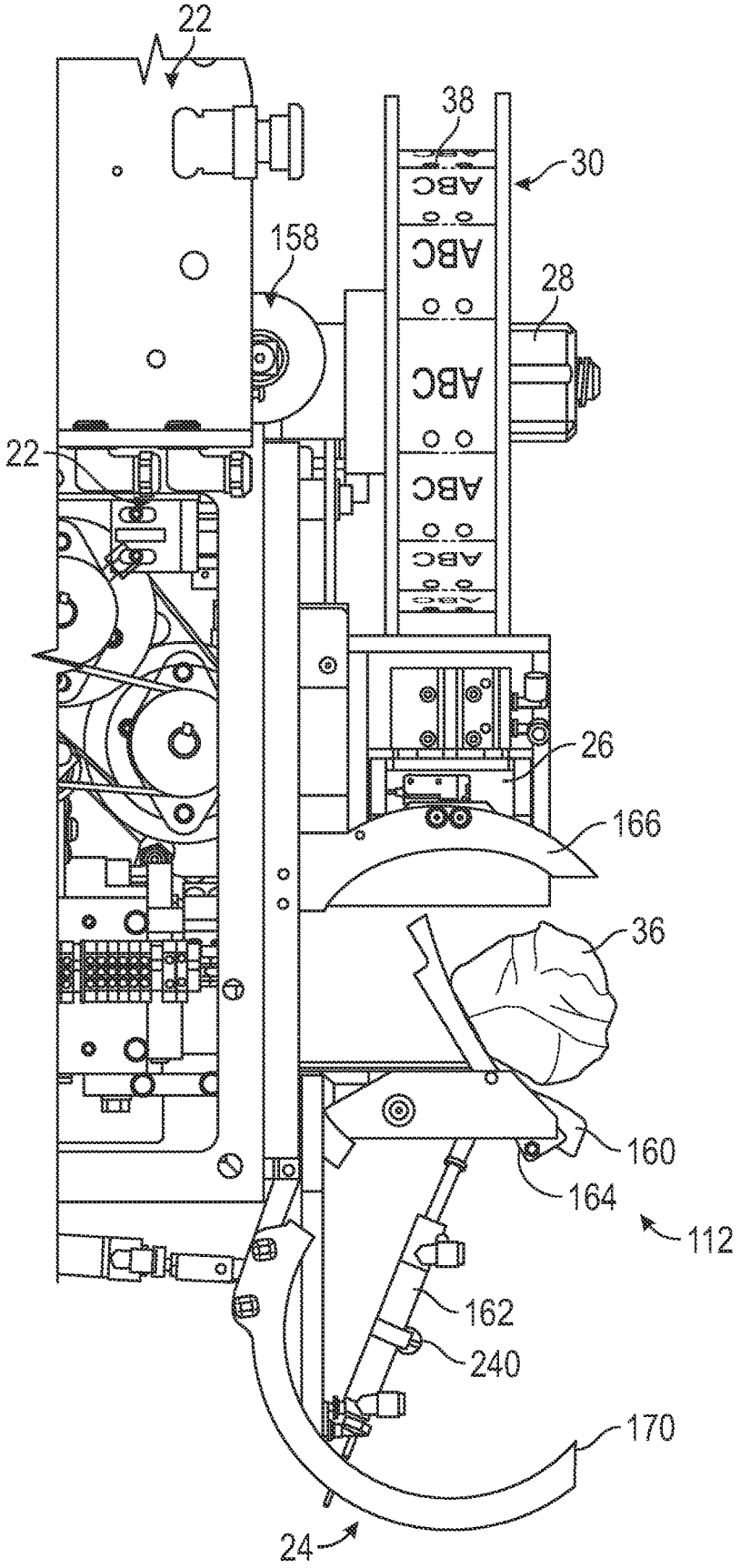
FIG. 6B is a side view of the system of FIG. 6A.

Once the twist labeling article 84 has been applied to product 36, ring 24 opens, as shown in FIG. 5. As shown in FIGS. 6A, 6B, 15C and 15D, packing fingers 160 retract and tray 164 automatically raises (by actuation of cylinder 162) to push or dump tagged and banded product 36 off shelf 110 and dump table 112. As shown in FIG. 6B, bottom portion 168 of ring 24 opens enough that its forward tip 170 recedes behind dump table 112; thus, any falling product 36 does not get caught on the open bottom portion 168 of ring 24. As shown in FIGS. 2A-6B, this operation results in the simultaneous banding and tagging of the product 36 with labeling article 84. In an exemplary embodiment, the illustrated steps for one cycle are completed in about 3 seconds with little user motion or intervention. The cycle repeats for each successive product to be banded and tagged.

Figure 8:
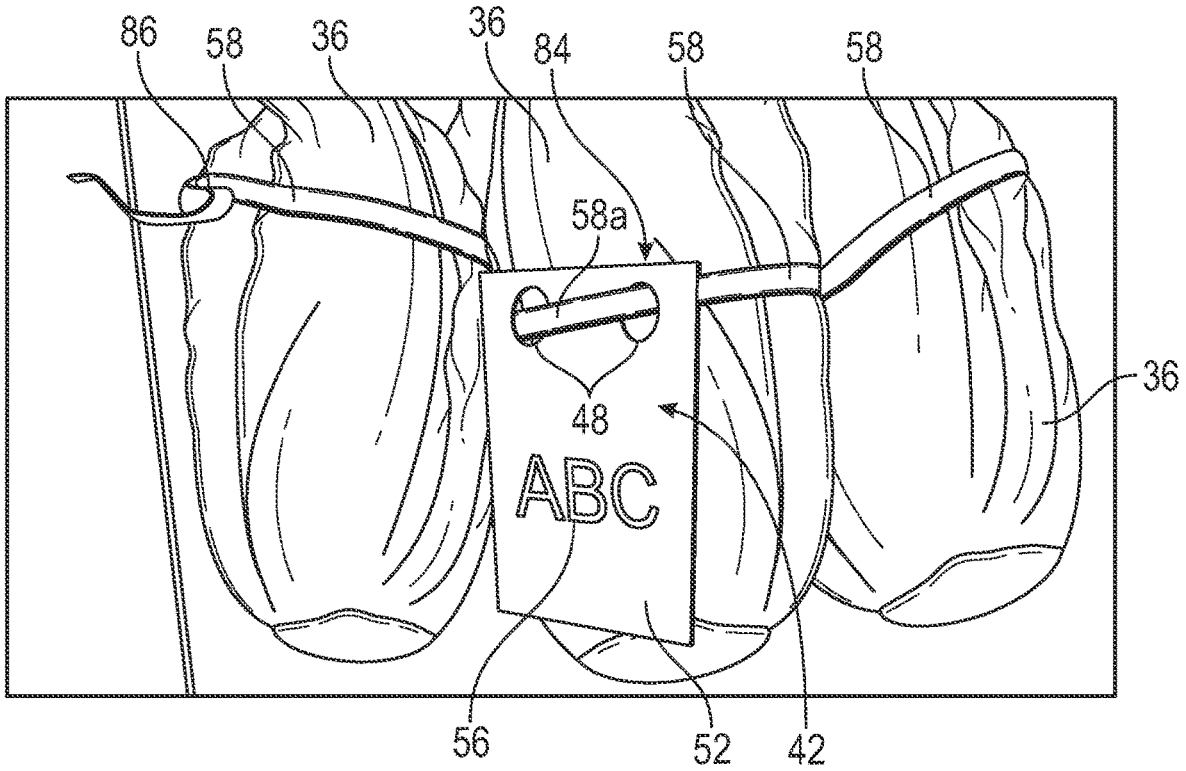
FIG. 8 shows a plurality of tied and tagged products; some tags are not visible because they are behind the product.
Figure 9:
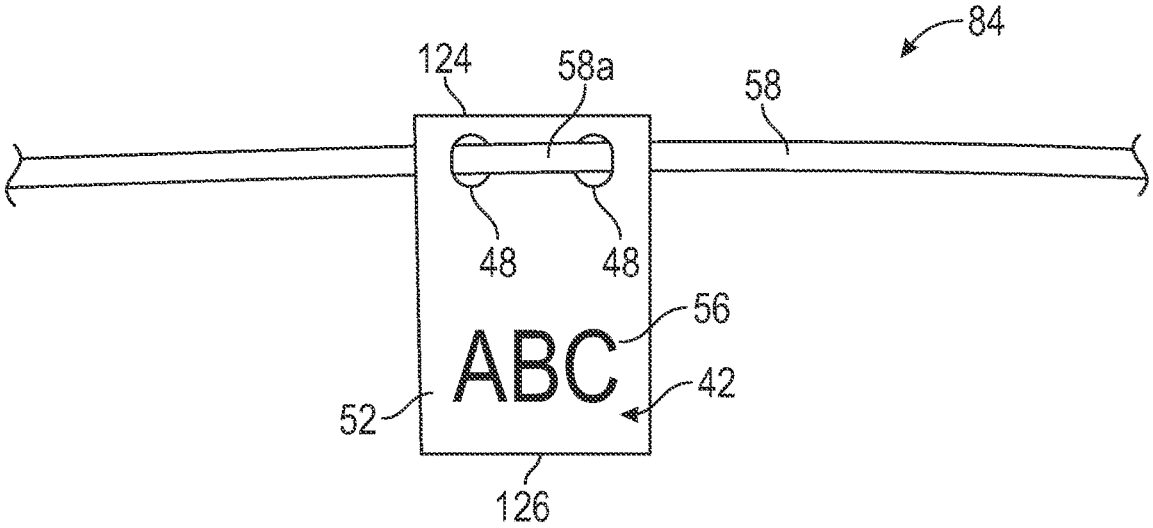
FIG. 9 is a plan view of an exemplary twist tie labeling article.
Figure 10:
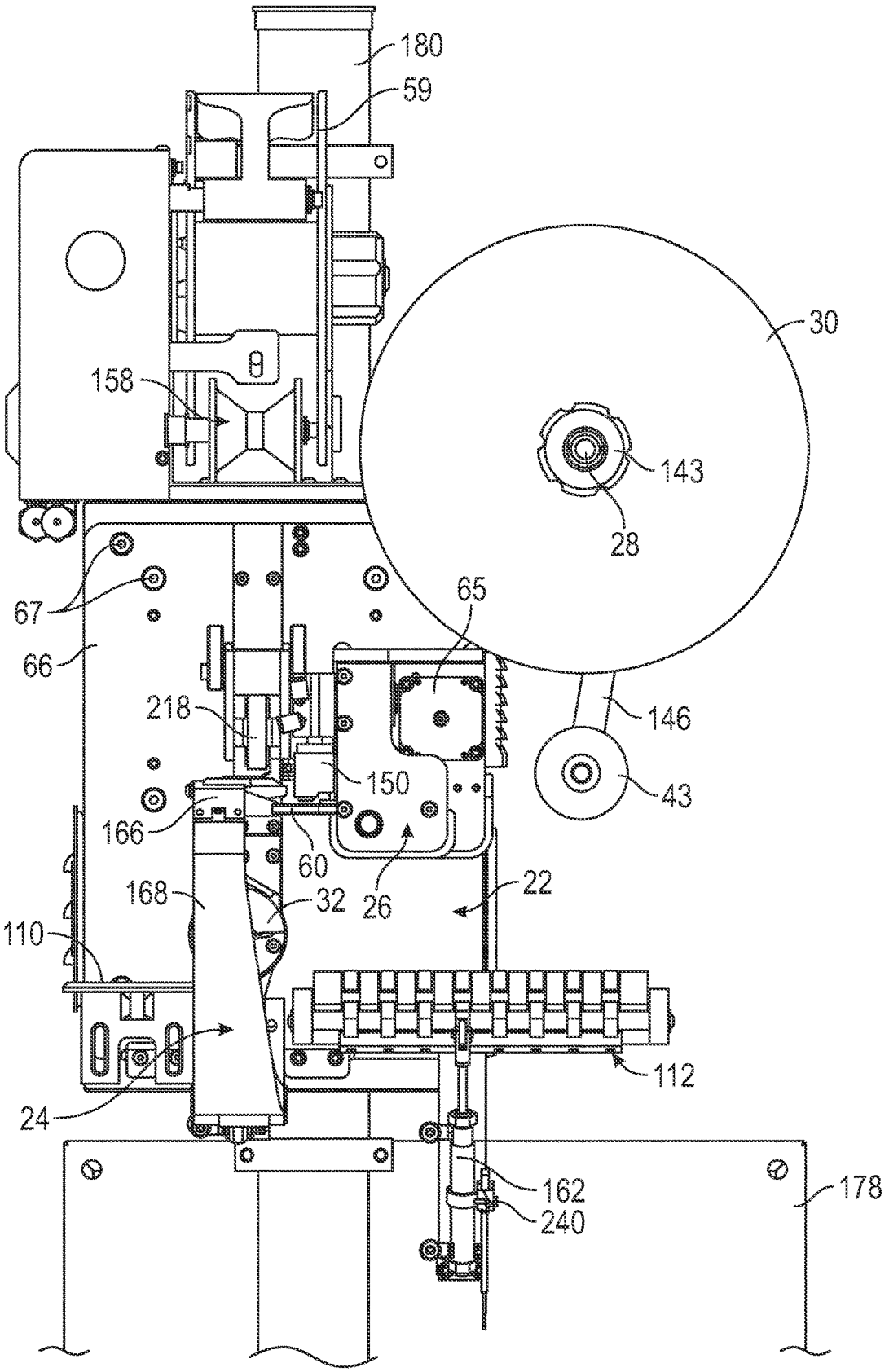
FIG. 10 is a partial front view of the system.

As shown in FIGS. 8 and 9, article 84 comprises a tag 42 having twist tie 58 inserted through one or more apertures or openings 48 of the tag 42. Labeling article 84 is sometimes referred to as a twist tie article or a bib tie article, or variations thereof. Twist tie 58 has been cinched around the product 36, cut to an appropriate length, and twisted closed with closure 86. The twisted closure 86 of the twist tie 58 secures the article 84 onto the product 36. The article 84 includes a visible expanse 58*a* of twist tie 58 between the two apertures 48 of tag 42 (see FIG. 8). While all of the products depicted in FIG. 8 carry a twist tie labeling article 84, a tag 42 for some of the products 36 is behind the product and therefore is not visible, so that other features, such as twisted closure 86 are visible.

Some products 36 can be inserted into a ring 24 from a side thereof, thereby not requiring split 34. However, some products (such as a coiled hose, for example) are most efficiently banded with a twist tie 58 that travels through an interior of the product. In this case, opening and closing of ring 24 by actuator 116 at moveable connection 114 allows a portion of a product 36 to be inserted into the ring 24 at the open split 34. An additional split 34 in bottom portion 168 facilitates the opening of ring 24, as shown in FIGS. 2B and 14B, for example.

A suitable tying machine for use in system 20 includes a Ring Tyer™ machine commercially available from Bedford Industries, Inc., of Worthington, Minnesota. However, this disclosure describes a different tying machine 22. The described machine 22 feeds a continuous length of twist tie 58 (labeled in FIGS. 8, 9, 12C and 14A) from a supply such as spool 59 through twisting barrel 32 and to ring 24. The twist tie 58 travels in a channel 72 on an interior of the ring 24 to surround a portion of product 36 inserted into the opening 25 of the ring 24. Mechanisms in twist barrel 32 cut and twist the twist tie strip 58 after pulling it tightly around the product or product portion 36 inserted into the ring 24 (as shown in FIGS. 2A-6B). In some embodiments, ring 24 has one or more splits 34, allowing it to open (into top ring portion 166 and bottom ring portion 168, for example) for insertion of a portion of product 36 into ring 24 from the front of the machine 22 (rather than inserting the product 36 into the opening 25 of the ring 24 from the side thereof).

In cases in which the ring 24 has a split 34, the ring is initially in an open position (see FIGS. 2A and 2B). At the initiation of each tying and tagging operation cycle, the machine 22 closes the ring 24 about the portion of the product 36 to be tied (see FIGS. 3 and 4), such as by actuation of cylinder 116. The operation of machine 22 to (1) close the ring 24 (if necessary), (2) feed a length of twist tie 58 around a channel 72 on the inside of the closed ring 24 and thus around the product portion 36 disposed within the ring 24, (3) cut and twist the twist tie 58 to form twisted closure 86 (and thus the twist tie labeling article 84 on the product 36), and (4) dump the tagged and tied product 36 from the product shelf 110 and dump table 112 can be accomplished by means such as by operation of a foot pedal (not shown), for example, or by automatic means, such as a contact sensor triggered by product contact, or optical proximity sensor, for example.

Figure 7A:
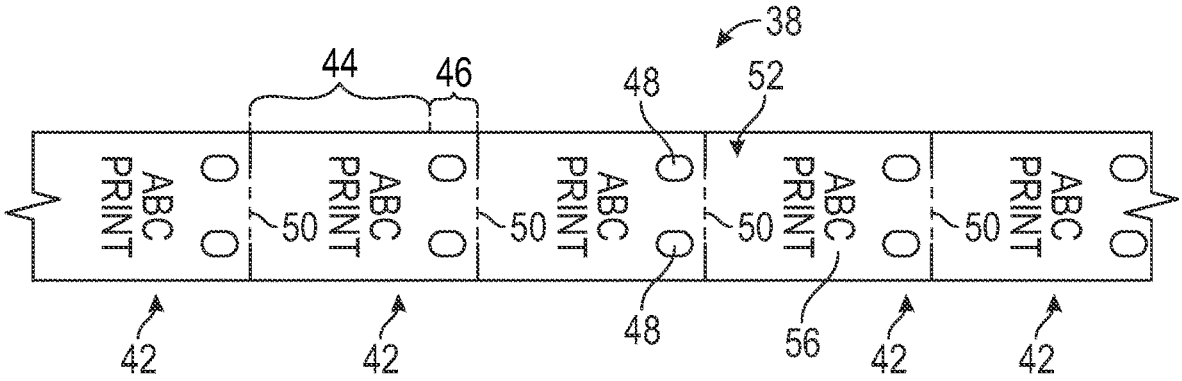
FIG. 7A is a front view of a portion of a tag strip of web material.

FIG. 7A is a front view showing a portion of a continuous tag strip 38, comprising a plurality of ruptureably connected tags 42. In an exemplary embodiment, on tag 42, the area of an information portion 44 is greater than an area of an attachment portion 46. In an exemplary embodiment, the attachment portion 46 of a tag 42 is defined as including apertures 48 and extending to the closer of two separation lines 50 to the apertures 48. In an exemplary embodiment, the information portion 44 of a tag 42 is defined as an area not including apertures 48 and extending to the farther separation line 50 from the apertures 48. In an exemplary embodiment, both front surface 52 and rear surface 54 (labeled in FIG. 7B) of the tag 42 can include indicia 56, such as printed matter. In an exemplary embodiment, the information portion 44 and the attachment portion 46 are integral.

In many cases, the tag 42 displays indicia 56, which may include not only human detectable indicia, but also machine detectable indicia (such as a UPC bar code, for example). Provision of indicia 56, such as by printing, embossing, inlaying, or engraving, for example, is accomplished in an exemplary method before tag 42 and twist tie 58 are assembled together. In some cases, the indicia 56 are provided on the tag 42 during tag manufacture. Alternatively or additionally, indicia 56 can be added to tag 42 at the merchandise production or packaging facility to impart more specific information such as a "pick date," expiration date, farm identification, facility location, block chain authentication code, or lot number, for example.

In descriptions of tag 42, this disclosure will sometimes refer to a "front" surface 52 and a "rear" surface 54. Such terms are used for purposes of describing the structure with reference to the drawings. However, it is understood that either major surface 52, 54 of the tag 42 may face outward toward a viewer when applied to a merchandise product 36, and either or both surfaces 52, 54 of the tag 42 can carry visible or otherwise detectable indicia 56. Surfaces of tag 42 and twist tie 58 may be treated to accept printing thereon or to enhance the visibility or durability of information disposed thereon (e.g., such as by applying a coating thereto). Indicia 56 may be provided on either or both of tag 42 and on twist tie 58. Printing capabilities may also be added to the system 20 by provision of a printer, such as one positioned between dancer roller 43 and tag feeding assembly 26, for example.

The web or sheet material of tag strip 38 is preferably tear resistant and ideally is formed from a polymer. Suitable tag material substrates include the following (for example and without limitation): [1] 10 mil (0.25 mm) thick Artisyn™ synthetic paper, product no. UAR 100, available from Protect-All Print Media, Inc., Darrien, Wisconsin, at a width of 8.5 inches (21.59 cm); [2] 7.5 mil (0.19 mm) thick Teslin™ synthetic paper or 7 mil (0.18 mm) SP 700, available from Technicote, Inc., Cuyahoga Falls, Ohio (made by PPG Industries, Pittsburgh, Pennsylvania), at a width of 8.5 inches (21.59 cm); or [3] 4 mil (0.10 mm) thick polyethylene terephthalate (PET) Tairilin film, product nos. CH284, CH885 and Cy18, available from Nan Ya Plastics Corporation USA of Wharton, Texas, at widths of 5-15 inches (12.7-38.1 cm).

Figure 7B:
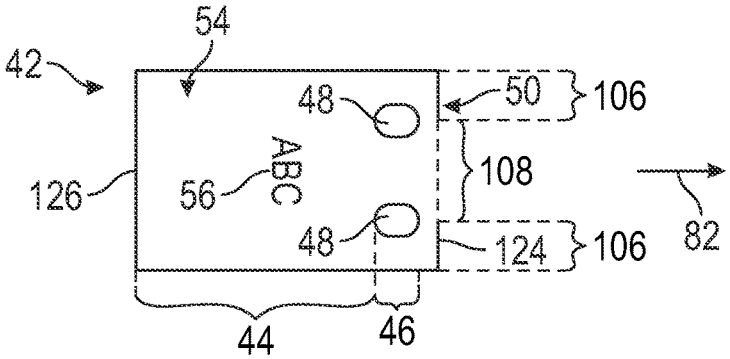
FIG. 7B is a rear view of an exemplary tag.

In an exemplary embodiment, tag strip 38 may include weakened separation lines 50 between adjacent ruptureably connected tags 42. Separation line 50 defines the boundary between the leading edge 124 of a tag 42 and the trailing edge 126 of the ruptureably attached adjacent tag 42, wherein the terms "leading" and "trailing" are relative to the tag insertion direction 82 into the tag receiving portion 40 of ring 24 (see FIGS. 12C, 13A, 13B and 13G). As shown in FIG. 7B, in an exemplary embodiment, separation line 50 includes through cut segments 106 at the sides of tag 42 and a perforated central segment 108. The through cut segments 106 facilitate full separation of a tag 42 from the strip 38 when desired. While the illustrated embodiment shows separations lines 50 formed with perforations, it is contemplated that other configurations of weakened separation lines can also be used, including for example, score lines, cut lines of full or partial depth, and other mechanisms for forming a rupturable line or contour of weakness. Although the separation lines 50 are illustrated as linear and laterally extending across the strip 38, it is contemplated that the separation lines 50 need not be linear or laterally extending. For instance, the separation lines could be defined as curved lines or serpentine lines between adjacent tags 42. In addition, tags 42 having shapes other than generally rectangular could be formed by die cutting in desired shapes.

Figure 7C:
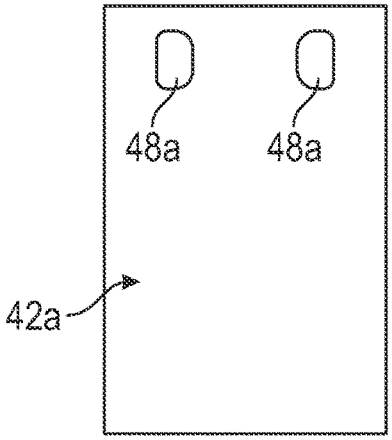
FIG. 7C is a plan view of a second exemplary tag.
Figure 7D:
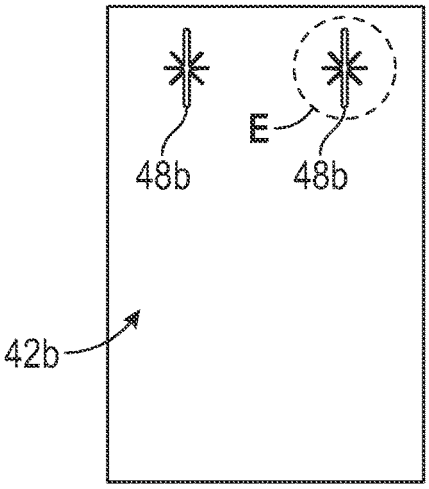
FIG. 7D is a plan view of a third exemplary tag.
Figure 7E:
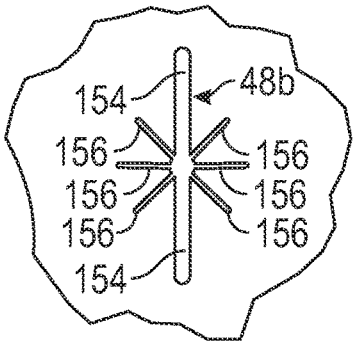
FIG. 7E is an enlarged view of the encircled portion of FIG. 7D labeled "E."

FIGS. 7C-7E show other exemplary embodiments of tags 42*a* and 42*b* having apertures 48*a* and 48*b*. All descriptions of tag 42 and aperture 48 also apply to tags 42*a*, 42*b* and apertures 48*a*, 48*b* unless stated otherwise. For example, while not explicitly labeled in FIGS. 7C and 7D, tags 42*a*, 42*b* also have information portion 44, attachment portion 46, front surface 52, rear surface 54, indicia 56, weakness lines 50 formed with through cut 106 and perforated segment 108, leading edge 124 and trailing edge 126.

In exemplary embodiments, each of tags 42, 42*a* and 42*b* has an overall length (between separation lines 50) of about 3 inches (7.62 cm) and an overall width (perpendicular to the length) of about 2 inches (5.08 cm). In an exemplary embodiment, aperture 48, 48*a* is about 0.40 inch (1.016 cm) long and about 0.25 inch (0.635 cm) wide. In an exemplary embodiment, aperture 48*b* is about 0.44 inch (1.118 cm) long between the radius ends of primary slit 154 and is about 0.25 inch (0.635 cm) wide between the radius ends of the horizontally shown minor slit 156. In an exemplary embodiment, each aperture 48, 48*a*, 48*b* is spaced from about 0.34 inch (0.863 cm) to about 0.38 inch (0.965 cm) from a closest separation line 50 (measured from the center of each aperture). Two apertures 48, 48*a*, 48*b* of a single tag 42, 42*a*, 42*b* are spaced about 1 inch (2.54 cm) apart from each other (measured from the center of each aperture). Additionally, each cut-through segment 106 is about 0.5 inch (1.27 cm) long, and the perforated segment 108 is about 1 inch (2.54 cm) long. These dimensions are suitable for a particular product, size of ring 24, and width of twist tie 58; it is contemplated that tag dimensions may differ for different implementations of the disclosed system.

As shown in FIG. 7C, tag 42*a* has apertures 48*a* that have a substantially "D" shape, with longer outer straight sides. As shown in FIGS. 7D-7E, tag 42*b* has apertures 48*b* that have a plurality of intersecting slits forming a substantially "star" shape. In an exemplary embodiment, primary vertical slit 154 (which in use is aligned parallel with tag insertion direction 82 shown in FIGS. 13G and 13H) is greater in length and width than radiating minor slits 156. In an exemplary embodiment, 45 radial degrees separate each leg of the slits 154, 156.

While particular configurations of ruptureably connected tags 42 in a strip 38 are illustrated, it is contemplated that many other different configurations of tags 42 can be used. For example, apertures 48 can have other shapes, such as circular, square, or rectangular, or outlines of whimsical shapes, for example. Moreover, while two discreet apertures are shown in an interior of a tag surface, openings for passage of twist tie 58 can be instead provided by slots that extend to a perimeter of the tag 42. In any case, apertures 48 or equivalent slots preferably allow for passage of twist tie 58 therethrough without interfering with surrounding material of tag 42. This allows for smoother operation of machine 22 and prevents damage to tag 42 as well as disruptions in operation that may be caused by improper threading or jamming of twist tie 58 through apertures 48. In an exemplary embodiment, the apertures 48 are no larger than necessary for reliable operation because a closer fit of twist tie 58 through aperture 48 leads to a more stable twist tie labeling article 84, in which the tag 42 is securely held on the product 36. Moreover, close tolerances between the twist tie 58 and the aperture 48 lead to a more reliable assembly configuration, in which tags 42 of similarly tagged products 36 appear uniform in orientation with little tilt or other placement variation.

Twist tie 58 includes a deformable wire that can be twisted into a closure 86 (see FIG. 8) to hold tag 42 onto a product 36 and in some cases also to bundle portions of a product 36 together. In a method of using system 20, a large spool 59 of a continuous strip of twist tie 58 is fed through the machine 22 to extend through the cutting and twisting barrel 32 and into the ring 24 in direction 70 (see FIGS. 14A-14H). In an exemplary embodiment, the twist tie material 58 is an elongated flat strip or ribbon of paper or polymer sheet material surrounding and encapsulating a deformable deadfold wire, the ribbon having a width of about 5/32 inch (3.97 mm). However, other widths and many thicknesses of the wing material for twist tie 58 are suitable. In an exemplary embodiments, modifications in tie payout assembly 158, in ring 24, and in tag feeding assembly 26, including changes in geometry, can be made to accommodate different sizes and shapes of twist tie 58 and tag 42. In an exemplary embodiment, the twist tie 58 lacks distortion memory such that securing a band of the twist tie 58 about merchandise 36 is reliably accomplished by twisting a section of the twist tie with another section of the twist tie using only a 180 degree rotation motion applied to the sections of the twist tie by twist barrel 32, resulting in twisted closure 86, labeled in FIG. 8.

A common type of twist tie 58 includes a length of metal wire enclosed in a covering material of plastic or paper. However, metal-wire twist ties may be undesirable for use in some applications. For example, when food is commercially packaged for distribution to the public, it is desirable for the packaging to allow inspection of packaged food for contamination by foreign objects. One common method of inspecting food products involves the use of metal detectors to confirm that no metal scrap or shards have inadvertently been incorporated in the food product during production or packaging of the food product. Metal-wire twist ties preclude such use of a metal detector, since each package that is closed with a metallic wire twist tie would typically generate a response by the metal detector indicating the presence of metal on the food package. Thus, rather than simply detecting the presence of any undesired metal in the packaged food, the metal detector would also indicate, for each package, the presence of the metal-wire twist tie.

Thus, a polymeric twist tie 58 can be used including a polymeric wire comprising at least about 90% by weight of a high density polyethylene and having an average cross-sectional area ranging from about 0.3 square millimeters to about 1.0 square millimeter. An exemplary polymeric retention article exhibits a tying memory value less than 0.10 inch (2.54 mm) pursuant to a Tying Memory Test and exhibits a tying break value of less than two breaks per 50 attempts pursuant to a Tying Break Test.

Web-based processing may be used for the manufacture of tag 42 and twist tie 58 from a standpoint of economy, although batch processing and conveyor processing with indexing from station to station for specific operations can be useful (especially for uniquely designed or shaped tags). In web-based processing, the strip 38 of tag material is optionally given a surface treatment such as a corona surface treatment to enhance printing ink adhesion. The strip 38 can be repetitively printed with informational matter as intended for indicia 56 on each tag 42 to be later excised from the strip 38.

FIGS. 1A-1C and 10 show major components of system 20, including tying machine 22, tag payout assembly having spool 30 on support 28, tag feeding assembly 26, tie payout assembly 158, twist tie ring 24, product shelf 110 and dump table 112. Product shelf 110 can be useful for the consistent placement of product 36 to be tied and tagged, especially products that have a longer length or bulky shape. Any of the above-mentioned components can be replaced with other versions or eliminated if their function is not desired for a particular implementation.

FIG. 11A is a front perspective view of a tag payout and feed assembly, and FIG. 11B is a rear perspective view thereof. In an exemplary embodiment, tag spool 30 is configured with front and rear flanges to keep the spooled tag strip 38 in alignment. Tag spool 30 is held to tag supply support 28 by a threaded nut 143. In an exemplary embodiment, dancer roller 43 is biased outward (to the left as illustrated in FIG. 11B) by helical tension spring 144 acting on the payout dancer arm 146, which is pivotally attached to tag supply support 28 and payout brake pad 148. Thus, dancer roller 43 keeps tension on the tag strip 38 to maintain a flat, unwrinkled strip as it enters the tag feeding assembly 26. Additionally, tension on the tag web or strip 38 prevents the strip 38 from blowing in the wind or catching on parts of the tying machine 22 or tag feeding assembly 26.

Figure 12A:
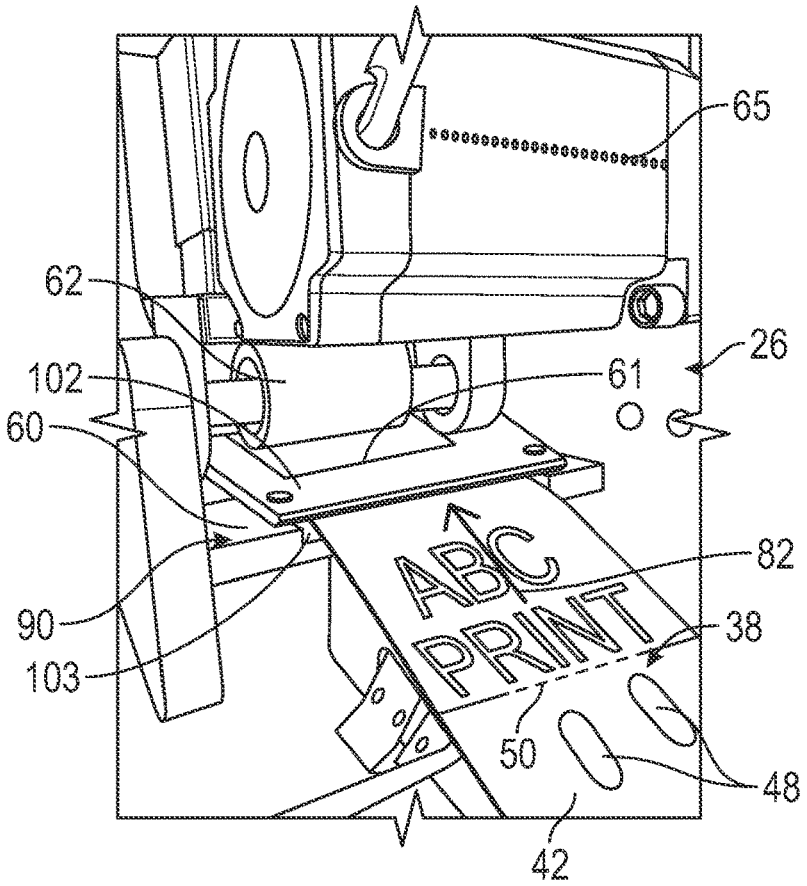
FIG. 12A is a top perspective view of a tag feeding portion of the system.
Figure 12B:
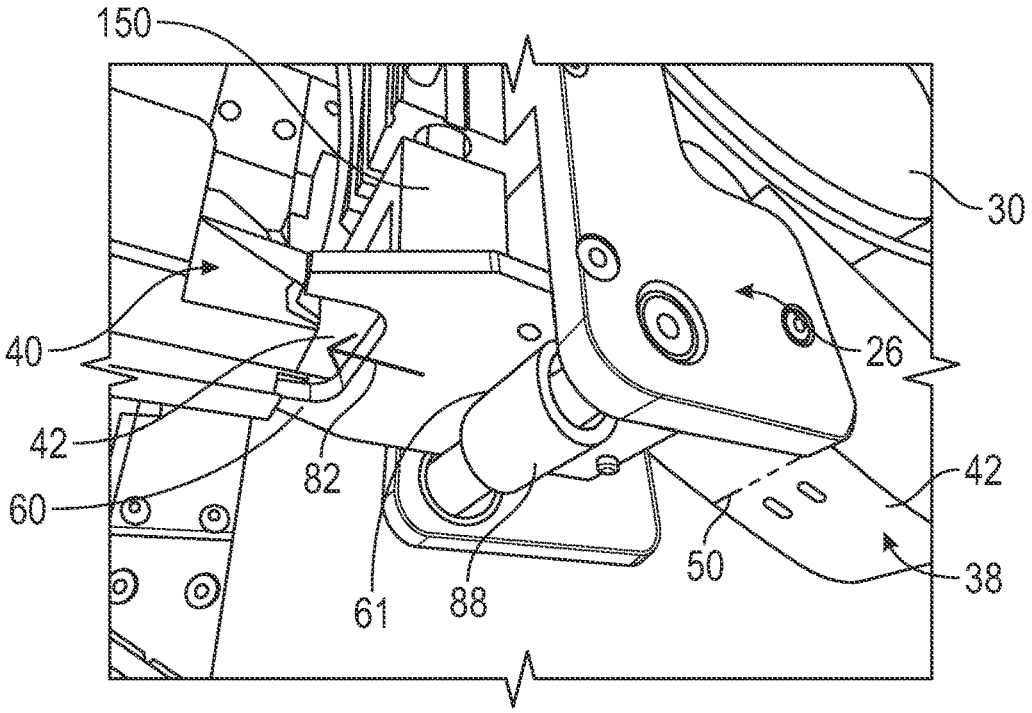
FIG. 12B is a bottom perspective view of the tag feeding portion.
Figure 12C:
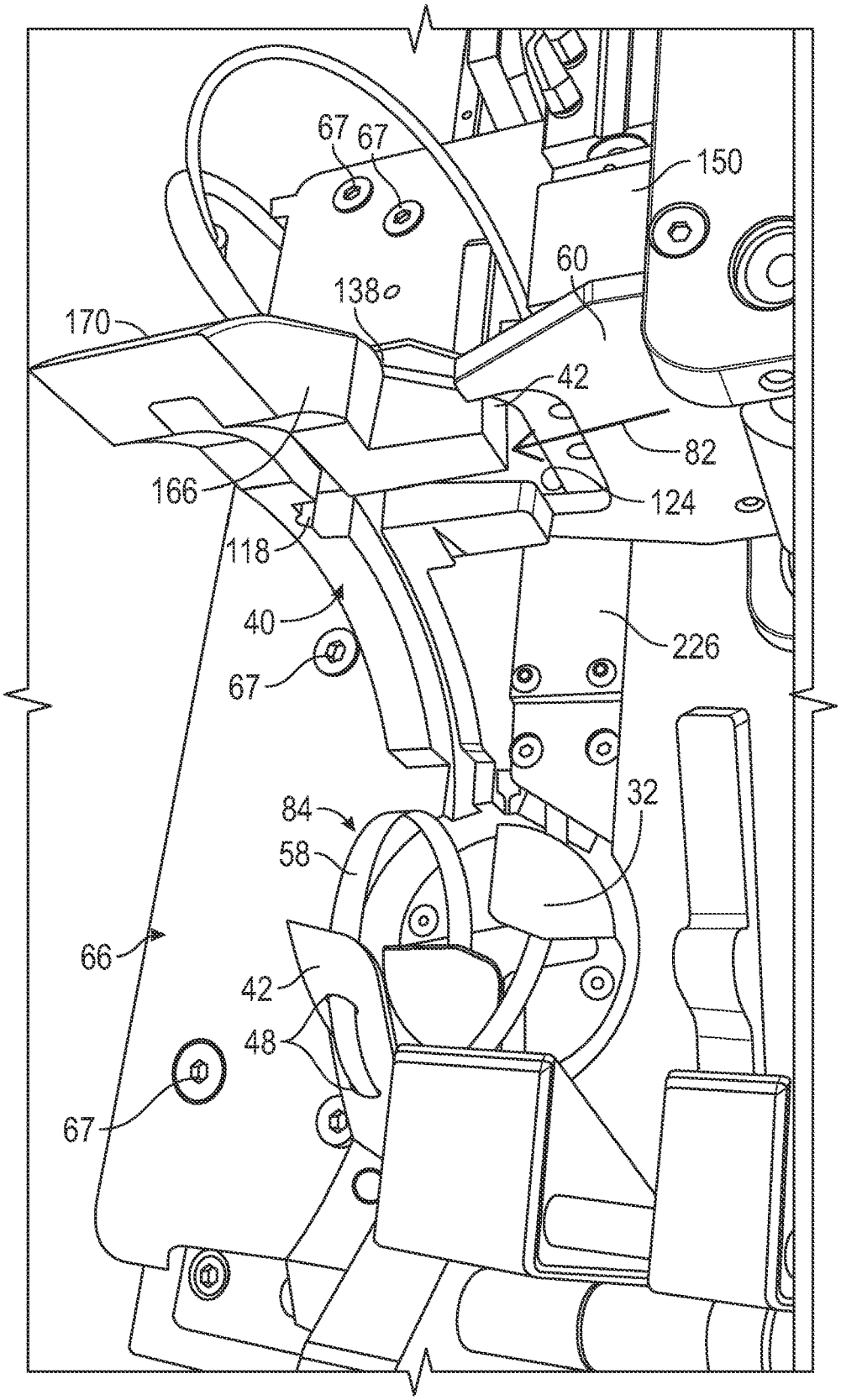
FIG. 12C is a bottom perspective view of the tag being fed to a tag forming portion of the ring.

As shown in FIGS. 12A-12C, in an exemplary embodiment, tag feeding assembly 26 feeds a tag web or strip 38 (shown in FIGS. 7A and 10-12B) of connected tags 42 into the tag receiving portion 40 of the tying ring 24. The tag strip 38 is routed from spool 30 and around dancer roller 43, to align a portion of the tag strip 38 with the tag feeding assembly 26. As shown in FIG. 12A, plate assembly 90 includes track plate 60 and hold plate 102, forming a channel 103 therebetween through which the tag strip 38 is conveyed from dancer roller 43 to ring 24. Track plate 60 also includes aperture 61 to allow for contact between a lower drive roller 88 and an upper nip roller 62 with tag strip 38. A motor 65 is configured to rotate drive roller 88. Tag strip 38 is conveyed at a nip between drive roller 88 and nip roller 62 (see FIGS. 12A and 12B). Rollers 62, 88 advance the tag strip 38 along track 60. Plate assembly 90 and top guide 138 insure that the tag strip 38 is relatively flat as it approaches the tag receiving portion 40 of ring 24. The tag feed roller assembly 62, 88 desirably has minimal operational structures, so that the drive is easy to maintain and keep clean, even in an agricultural environment that involves debris such as dirt or foliage. Moreover, a protective housing or shroud can be provided thereover, such as one including at least a cover plate 104 as shown in FIG. 11A.

While the illustrated tag feeding assembly 26 is configured to feed tags 42 to the tying ring's tag receiving portion 40 in the form of a tag strip 38 of ruptureably connected tags 42, in another embodiment, system 20 could use individual tags 42 that are fed into the tag receiving portion 40 of ring 24 in a different manner. For example, individually presented tags could be provided in a stack of completely separated tags 42, where each tag 42 in that stack is successively fed into alignment in the tag receiving portion 40 of ring 24. Alternatively, a cutter such as a laser, rotary cutter, or knife blade can be provided on the tag feeding assembly 26 to sever an individual tag 42 from the strip 38 as it is inserted into the tag receiving portion 40 of the ring 24.

As shown in FIGS. 12C-12E and 13D, a guide and sensor mount 138 guides tag 42 of fed tag strip 38 into the tag receiving and forming portion 40 of ring 24. In an exemplary embodiment, mount 138 includes sensor 63, which determines when tag 42 has been fully inserted into the tag receiving portion 40 of ring 24. In an exemplary embodiment, sensor 63 is configured as a fiber optic sensor with an optical beam extending through aperture 118.

Figure 12D:
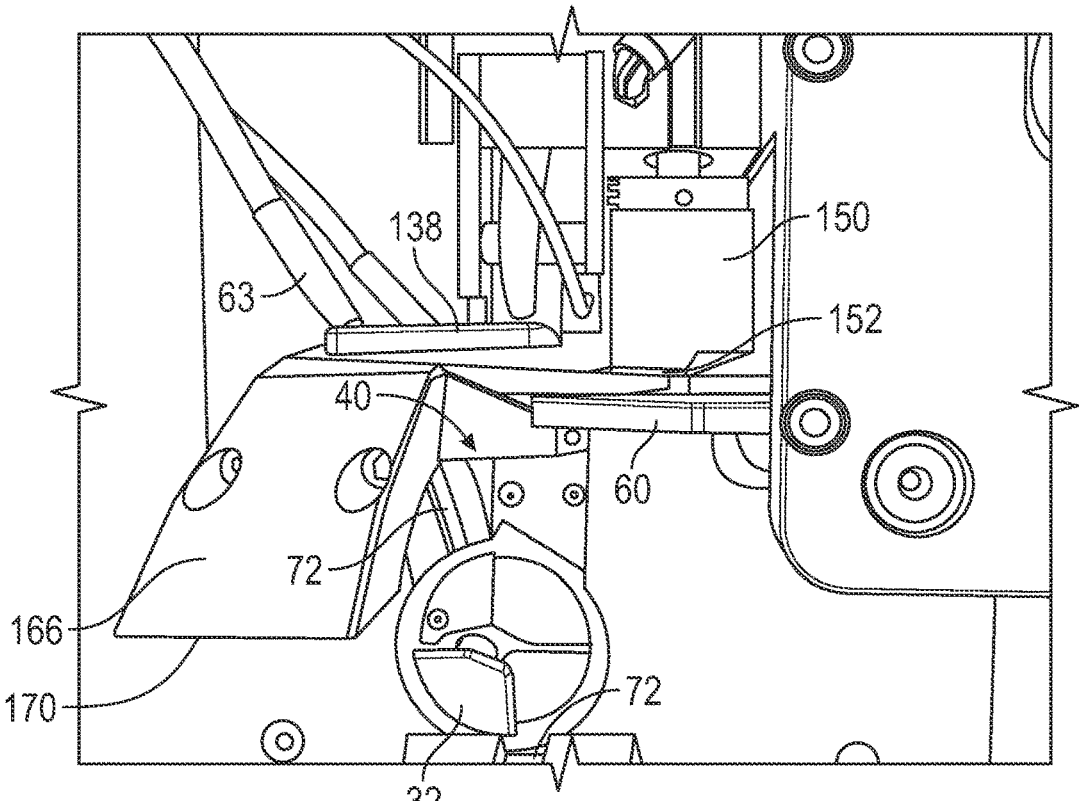
FIG. 12D is a front view of the tag being fed to a tag forming portion of the ring, wherein a tag separation clamp is in a raised position.
Figure 12E:
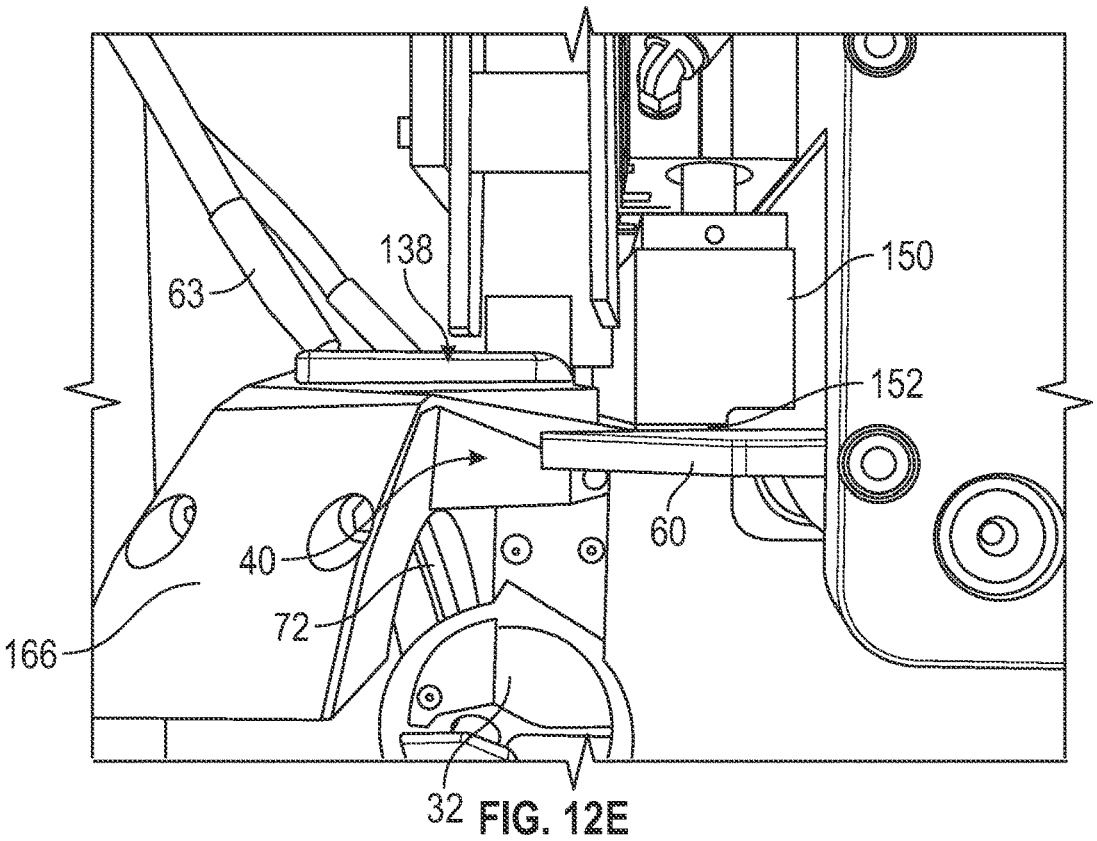
FIG. 12E is a front view of the tag being fed to a tag forming portion of the ring, wherein the tag separation clamp is in a lowered position.
Figure 13A:
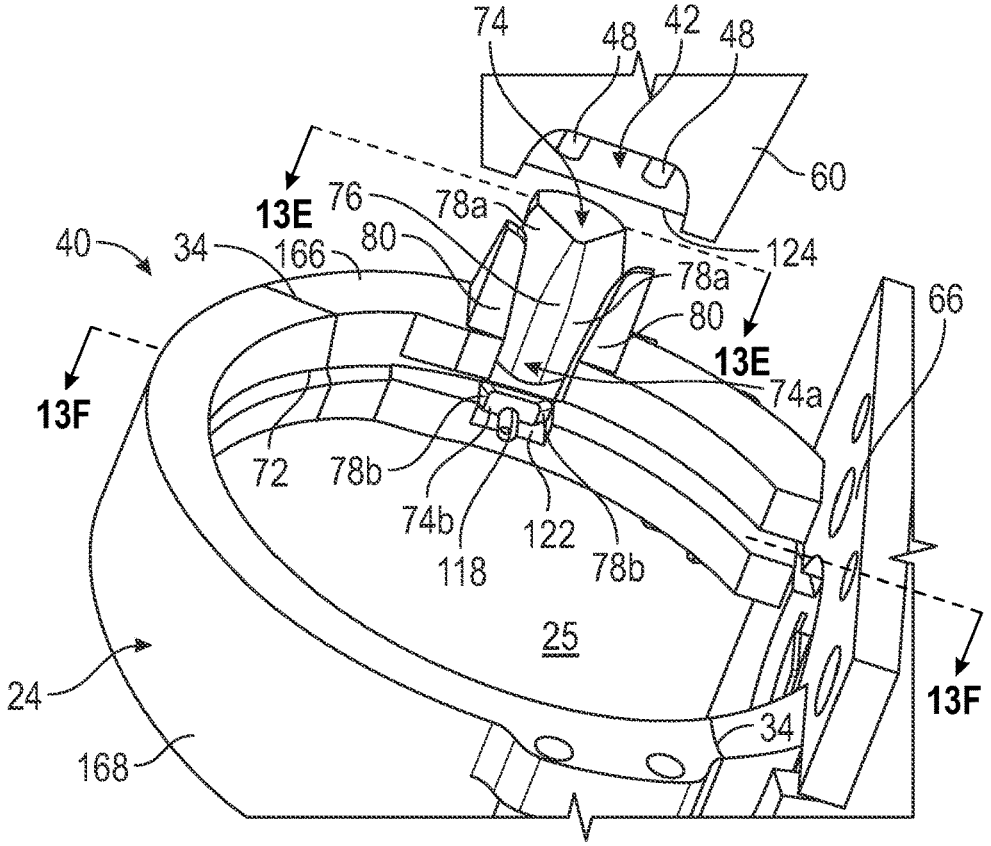
FIG. 13A is a partial perspective view looking up into the ring as a tag is fed toward the tag receiving portion of the ring.
Figure 13B:
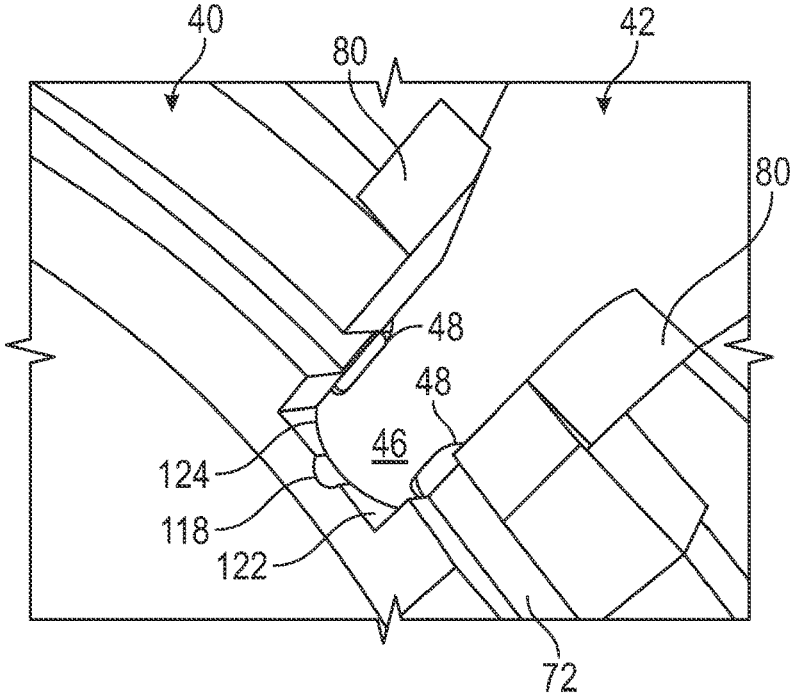
FIG. 13B is an enlarged perspective view of a tag fully inserted into a tag receiving portion of a ring, looking up into the ring.

FIGS. 12C, 13A and 13B show a leading edge 124 of a leading tag 42 of a tag strip 38. Tag strip 38 travels in tag insertion direction 82 (see FIGS. 12A-12C, 13G and 13H) through a channel 103 (labeled in FIG. 12A) provided between track plate 60 and hold plate 102. As shown in FIGS. 12D and 12E, a pressure assembly includes vertically movable clamp block 150 having a resilient pad 152 configured for contact with tag strip 38. When the tag strip 38 is indexed for motion toward ring 24 by motor 65, the clamp block 150 is raised as in FIG. 12D to allow motion of the tag strip 38 thereunder. When sensor 63 indicates that tag 42 is fully inserted into tag receiving portion 40 of ring 24, the tie payout assembly 158 feeds a length of twist tie 58 through channel 72 of ring 24 and also through apertures 48 of the inserted tag 42, as shown in FIG. 13B. Simultaneously or nearly so, an actuator such as a pneumatic cylinder is used to lower the pad 152 of clamp block 150 down into contact with the inserted tag 42 on track plate. The compressible, resilient pad 152 offers a contact surface with the tag 42 that frictionally engages the tag 42, yet does not cause damage to the tag. Rubbers and elastomers are suitable materials for pad 152. When tag 42 is fully inserted into tag receiving portion 40 of ring 24, as shown in FIG. 12E, the clamp block 150 holds down the first tag 42 against track plate 60, and motor 65 reverses the tag strip 38 to tear apart the first tag 42 and the next tag 42 at separation line 50. The clamp block 150 remains on the inserted tag 42 until the twist tie is inserted through its apertures 48. When the twist barrel 32 pulls the free end of the twist tie 58 back into the twist barrel, that end is clamped by a gripper in the twist barrel 32. An extra length of twist tie 58 (since the circumference of ring channel 72 is greater than a diameter of the product 36) is pulled back by feedroller 216 to cinch the tie about the product 36 before the twist tie 58 is cut and twisted. FIG. 12C shows a tagged length of twist tie 58 about to be cut and twisted. A product 36 is not shown, so that other structures are more visible. As shown in FIG. 12D, the clamp block 150 actuates upward to allow the tag feeding process to continue.

Figure 13C:
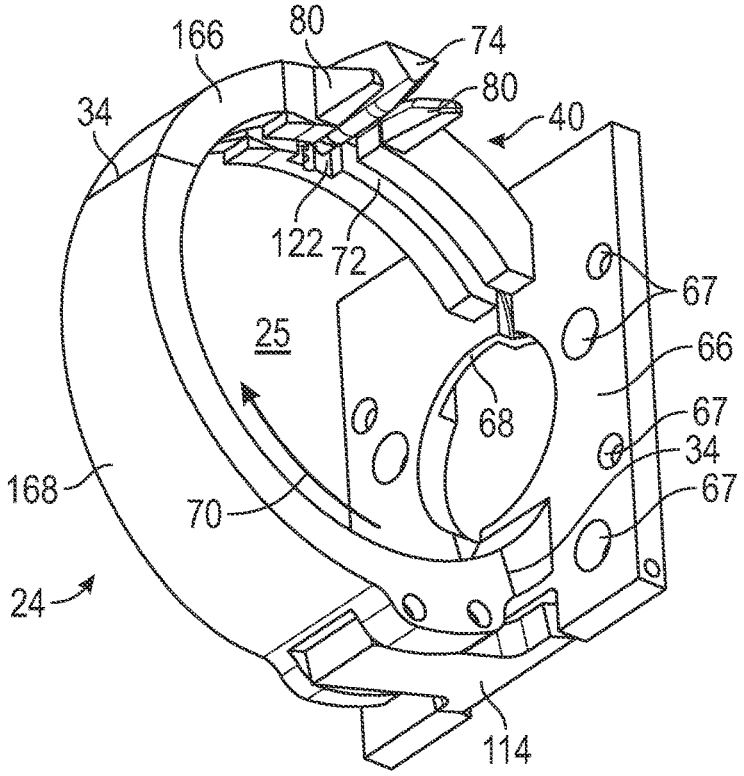
FIG. 13C is a perspective view of an exemplary ring for use with a tying machine (when its associated closing cylinder (not shown) is in a fully extended position).
Figure 13D:
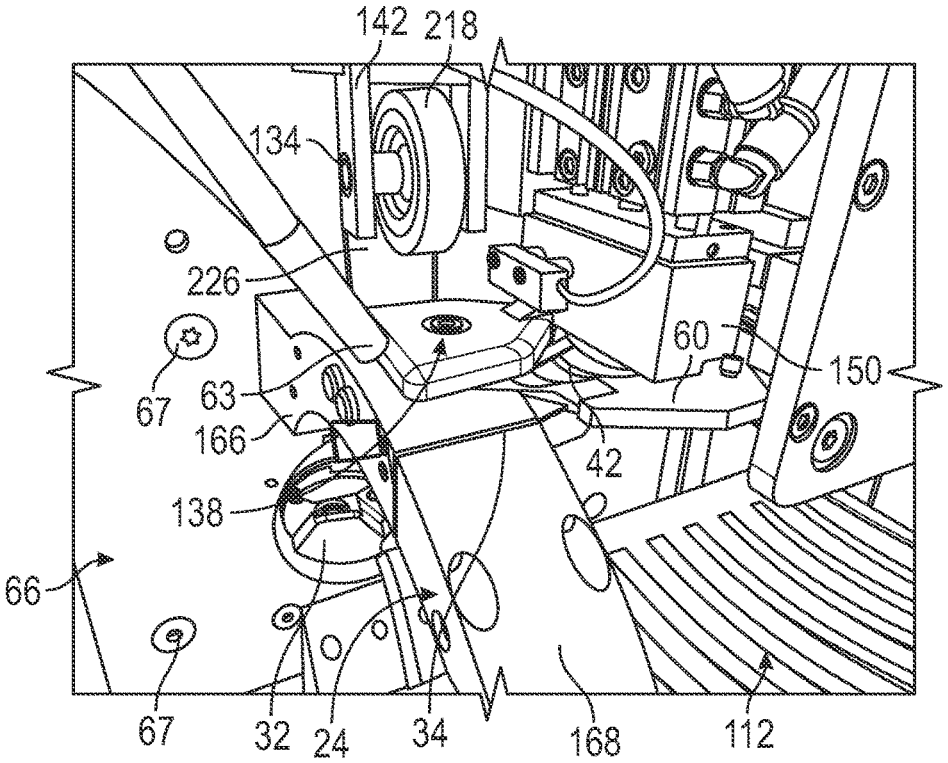
FIG. 13D is a top perspective view of a tag inserted into a forming section of the ring.
Figure 13E:
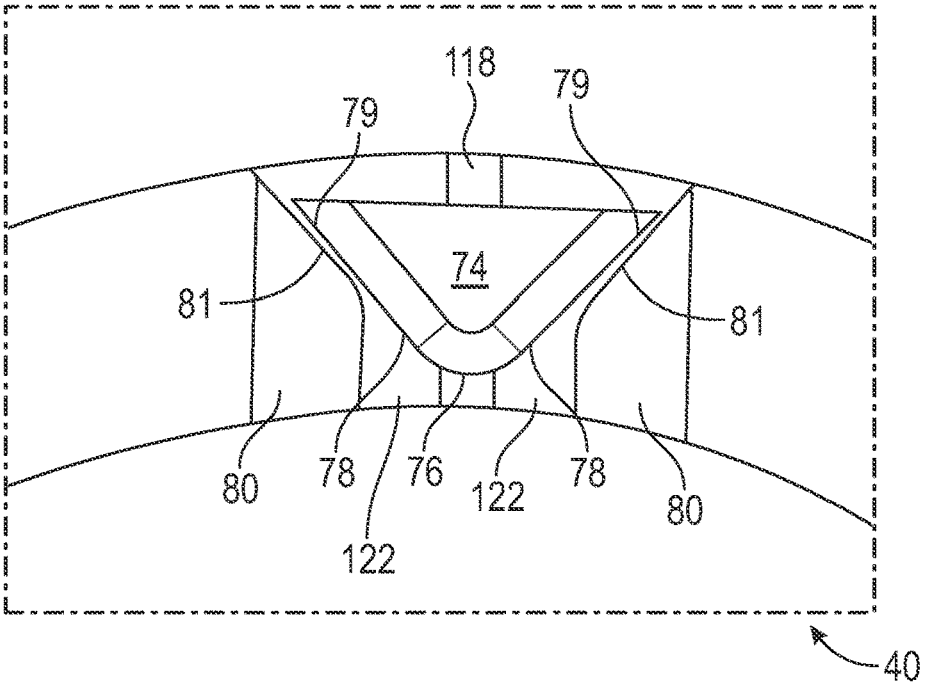
FIG. 13E is an elevation view of a tag receiving portion of the ring, taken at line 13E-13E of FIG. 13A.
Figure 13F:
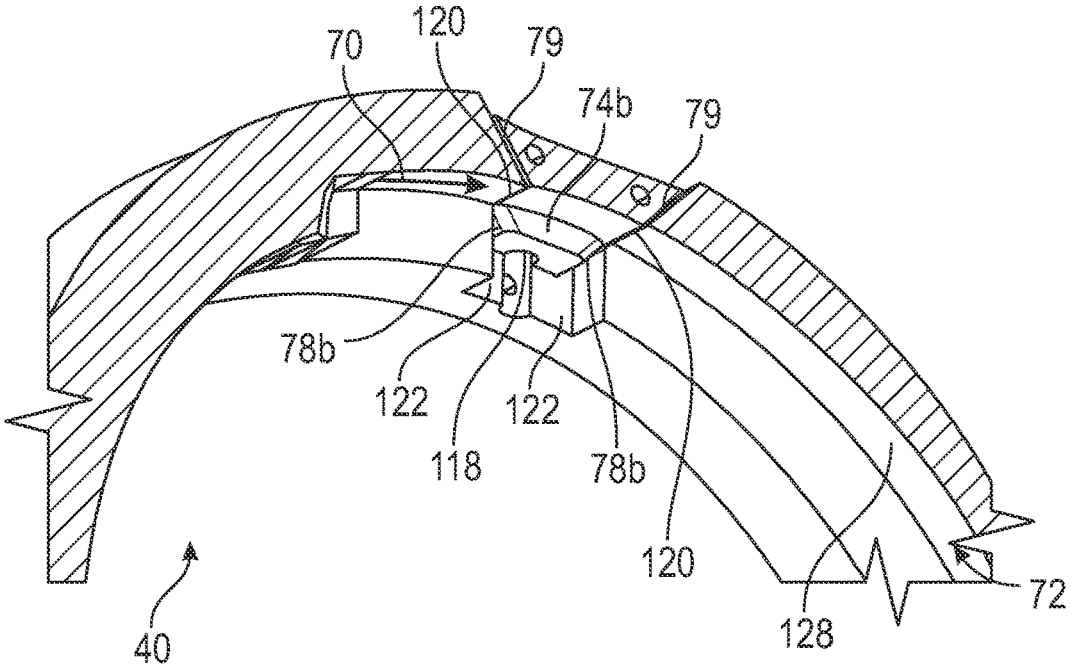
FIG. 13F is a partial cross-sectional perspective view of the ring, taken along line 13F-13F of FIG. 13A.
Figure 13G:
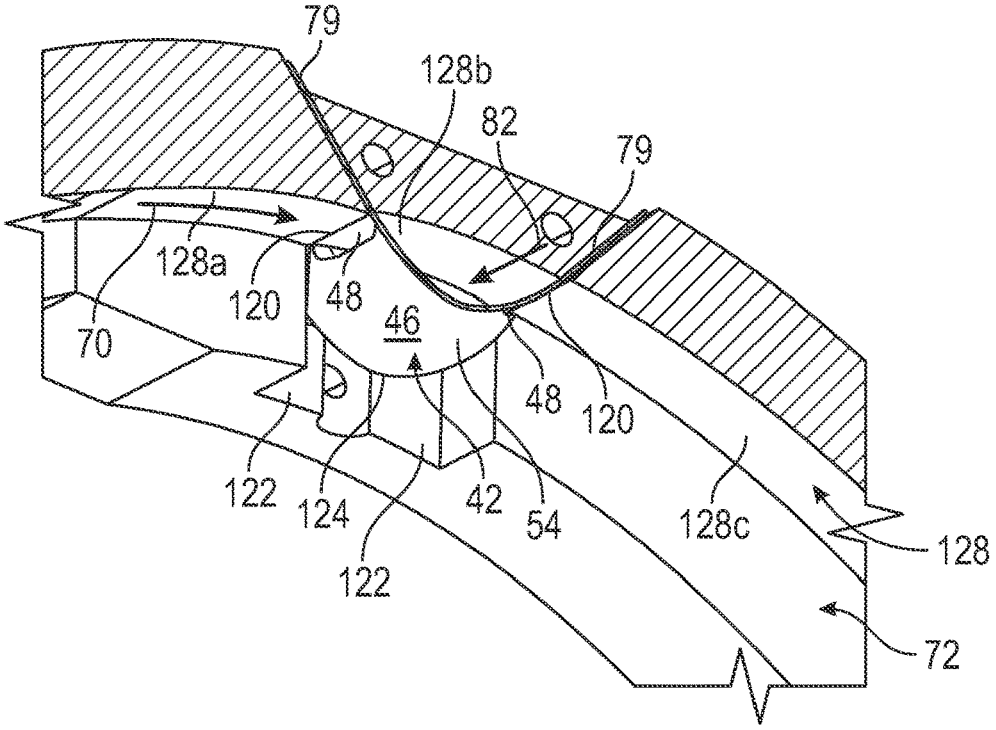
FIG. 13G is an enlarged portion of FIG. 13F, showing a cross-sectional view of a fully inserted top attachment portion of a tag.
Figure 13H:
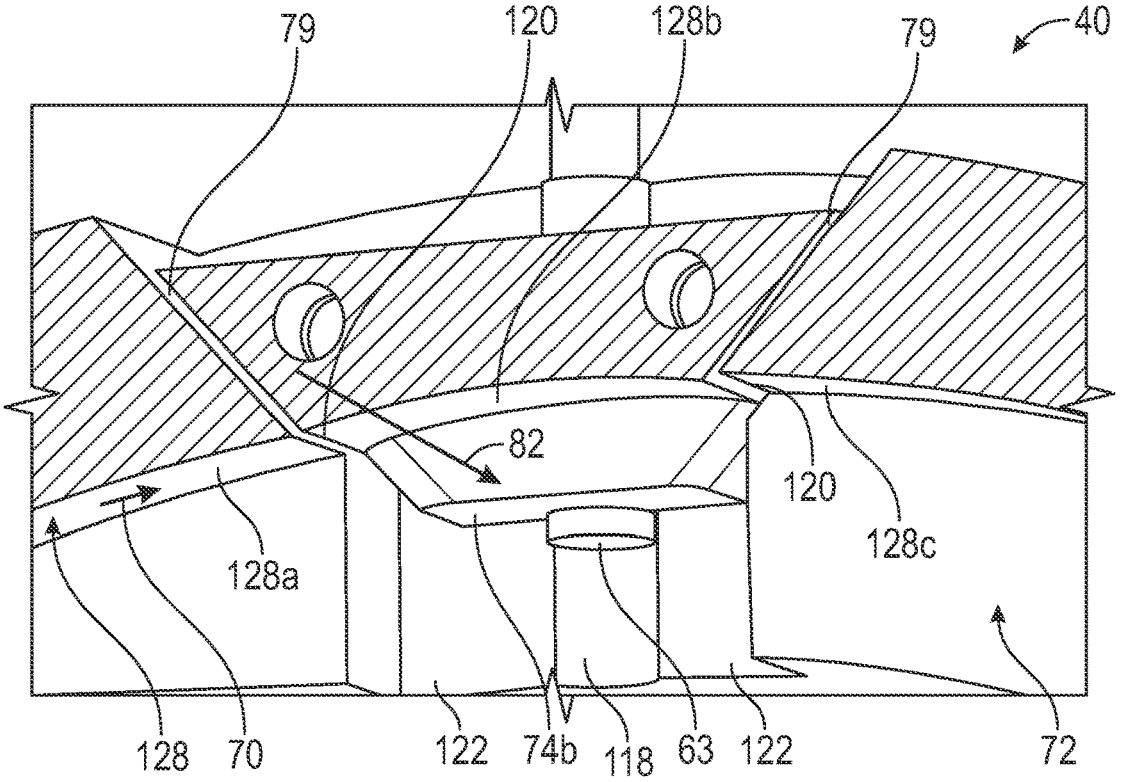
FIG. 13H is similar to FIG. 13G but with the tag removed and viewed from a different perspective.

FIGS. 13A-13H show views of exemplary tying rings 24 and especially their tag receiving portion 40. In an exemplary embodiment, ring 24 includes channel 72 through which twist tie 58 travels in direction 70 around an interior of ring 24. As shown in FIGS. 2A, 5, 6A and 12C—12D, in an exemplary embodiment, channel 72 is oriented slightly helically (thus not parallel to a vertical plane). Where the channel 72 meets the front of machine 22, one illustrated embodiment shows that the top of channel 72 is to the left of center of twisting barrel 32, while a bottom of channel 72 is to the right of center of twisting barrel 32. FIGS. 13F-13H are cross-sectional views taken through line 13F-13F of FIG. 13A. In FIG. 13A, ring 24 is illustrated as being spaced from track plate 60 so that structures of tag receiving portion 40 are more clearly visible; however, in an exemplary embodiment, plate assembly 90 feeds tag 42 of strip 38 directly into tag receiving portion 40 of ring 24 so that the tag travel path is structurally supported, as shown in FIGS. 12B, 12C and 13D, for example.

FIG. 13C is a perspective view of an exemplary ring 24 having a compact attachment plate 66 that can be attached to an existing tying machine to retrofit the machine for a tagging function as well as its tying function. Accordingly, a user in possession of a commercially available tying machine (such as a Ring Tyer™ machine from Bedford Industries, Inc., of Worthington, Minnesota) can simply trade out components thereof, such as ring 24, and add other components such as tag feeding assembly 26; tag supply support 28 and spool 30 of tag strip 38; and product shelf 110/dump table 112; in order to obtain a facsimile of the described automatic tagging system 20. However, other described features of system 20, such as the described twist tie payout, feeding, and reversing assemblies, would not be available with a commercially available tying machine. While an unmodified commercially available tying machine only bands merchandise, the described system 20 not only bands but also tags the merchandise inserted into ring 24 with a label (tag 42). In an exemplary embodiment, ring 24 includes an attachment plate 66 having various fastener apertures 67 therethrough to allow for attachment of ring 24 to a front face of a tying machine. Moreover, plate 66 includes a larger aperture 68 to allow for access of the machine's twisting and cutting barrel 32.

A detachable ring 24 allows rings of different configurations to be used with any tying machine. For example, some rings may be openable at split 34, while other rings do not open. In the illustrated embodiment, ring 24 has a split 34 and moveable connection 114 at a bottom end of the ring to allow for opening and closing of the ring at split 34 (as shown in FIGS. 2A-6B). In an exemplary embodiment, the opening and closing of ring 24 at split 34 is accomplished by an actuator 116, such as a pneumatic cylinder pivotally connected to the connection 114 at bottom portion 168 of the ring 24 (see FIG. 14B). In contrast, the tag receiving section 40 of the top portion 166 of the ring 24 is fixed relative to the tying machine 22 and the tag feeding assembly 26 to provide a tag alignment and attachment platform. It is to be understood that although the tag receiving portion 40 of the ring 24 is at a top of the ring 24 as illustrated, the ring 24 could be oriented otherwise, so that its tag receiving portion 40 is not at the top. A top location of the tag receiving portion 40 is advantageous in that dirt and other debris from harvested produce does not fall into the tag receiving portion 40. Interchangeable rings 24 can be provided in different sizes to accommodate different sizes of product 36. For example, a 6-inch (15.24 cm) diameter is a common ring size, though rings having 4-inch (10.16 cm) and 9-inch (22.86 cm) diameters could also be used. Moreover, interchangeable rings 24 may have differences in a width of channel 72 and/or a width of the ring 24. Other configurations of an automated tying and tagging system are provided in the Patent Cooperation Treaty international application having serial no. PCT/US2022/041041, filed Aug. 22, 2022, and entitled "Bib Tie Automation System."

Referring to FIGS. 13A-13C, in an exemplary embodiment, tag receiving portion 40 includes saddle 74, which has portions on both sides of channel 72 for supporting a tag 42 as it enters tag receiving portion 40. In an exemplary embodiment, saddle 74 is configured as a substantially triangular prism having a rounded tip or apex 76 and inclined sides 78 extending from the tip 76. Moreover, in an exemplary embodiment, tag receiving portion 40 includes a surface 81 (such as a top surface of a projection or finger 80) beneath each of the inclined sides 78 to bend a tag around the apex 76 of saddle 74 as the tag is inserted into the tag receiving portion 40. Inclined sides 78 extend (such as upward above the surface of channel 72) into respectively associated grooves 79 to accommodate the width and thickness of tag 42 at attachment portion 46. In an exemplary embodiment, each of the fingers 80 includes an upper ramp surface 81 extending into its respective groove 79. As shown in FIGS. 13E-13H, grooves 79 extend from saddle 74 and fingers 80, through channel 72, and to back wall 122, which is proximate sensor aperture 118.

Particular structures are illustrated and described for guiding attachment portion 46 of tag 42 into a tag receiving portion 40 of ring 24 to allow a twist tie 58 traveling through channel 72 to be inserted into apertures 48 of tag 42. However, other structures may be provided to accomplish this function. For example, while a forming shuttle or saddle 74 is illustrated as an element with a generally rounded triangular shape, a guide for tag 42 could have a different configuration. Moreover, while upper guides for tag 42 are illustrated as two projections or fingers 80 spaced from the inclined sides 78*a*, 78*b*, the curved guiding surfaces 81 could be disposed on a different structure. Moreover, the saddle 74 and projections 80 may have a more elongated, less prominently curved configuration than illustrated. The fingers or projections 80 may be static as shown, or may be movable (such as spring-loaded, for example) to allow for clearing of debris that may accumulate in grooves 79. Additionally, the guiding surfaces 76, 78, 81 need not be continuous as shown; rather, they can be formed of a series of pins, rods, or other elements that could be adjusted to different contours, for example. There are many ways in which the complementary guiding surfaces 76, 78, 81 can lead to channels or grooves 79 for the precise placement of tag 42 in ring 24.

In an exemplary embodiment, saddle 74 is split into two portions separated by the channel 72. As shown in FIG. 13A, saddle 74 has a proximal portion 74*a* adjacent fingers 80 and a distal saddle portion 74*b* which has partial inclined sides 78*b*, which may be similar is shape to the inclined sides 78*a* of proximal saddle portion 74*a* (in other embodiments, the inclination orientations of sides 78*b* may be different, such as inclined more or less, from those of sides 78*a*). However, distal saddle portion 74*b* does not have an apex; rather, a top surface accommodates detection aperture 118 for operation of sensor 63. In an exemplary embodiment, sensor 63 sends an optical beam downward from mount 138 through aperture 118 to detect when tag 42 has been fully inserted into tag receiving portion 40, by virtue of its interruption of the optical beam (see FIG. 13B). Other suitable sensors 63 may operate by other mechanisms to determine the presence of a fully inserted tag 42.

FIGS. 13B and 13G illustrate tag 42 inserted fully into the tag receiving portion 40 of ring 24 in insertion direction 82, with its attachment portion 46 bent under saddle 74 and over guiding surfaces 81. Moreover, parts of tag attachment portion 46 of tag 42 are disposed through grooves 79. A leading edge 124 contacts back wall 122, and tag 42 is positioned with apertures 48 of its attachment portion 46 aligned in channel 72. Accordingly, when twist tie 58 travels along channel 72 in direction 70, the twist tie 58 will be automatically inserted through the apertures 48. The attachment portion 46 of tag 42 is bent into shape for proper placement of apertures 48 at channel 72. Tag 42 has an appropriate balance of flexibility and rigidity to retain that shape even though distal saddle portion 74*b* does not have an apex. The side of the tag 42 facing the viewer is the rear surface 54, as it will face and lie against a product 36 inserted into the ring 24 (see FIG. 5).

As shown in FIGS. 13G and 13H, in an exemplary embodiment, ceiling 128 of channel 72 has a change in elevation or rise 120 at each groove 79 to present a different height in tie travel direction 70. One rise 120 is positioned at each intersection of groove 79 with the ceiling 128 of channel 72. Thus, a level of ceiling section 128*a* is a bit lower (when oriented as illustrated) than a level of ceiling section 128*b* at rise 120. Similarly, a level of ceiling section 128*b* is a bit lower than a level of ceiling section 128*c* at rise 120. These rises 120 insure that a twist tie 58 traveling against the ceiling 128 in direction 70 is not caught or stopped by the crack leading to groove 79. Stated another way, ceiling 128 steps up at each groove 79 to minimize a possibility of jamming of twist tie 58 in channel 72.

Once tag 42 is fully inserted into tag receiving portion 40 of ring 24, actuator 116 closes ring 24 to form a continuous twist tie travel channel 72 on an interior surface of the ring 24. In other ring configurations that do not have a spilt, no closure step is performed. Simultaneously, packing fingers 160 of dump table 112 pivot upward by actuation of cylinder 162 (shown in FIGS. 4, 15A and 15B) to gather the product 36 and push it toward twist barrel 32. While a unitary product is illustrated, such action of packing fingers is most advantageous for products consisting of multiple items. For example, a user can quickly place many carrots across the span of the product shelf 110 and dump table 112, and the raising packing fingers 160 will automatically gather the many carrots into a relatively compact bundle that is then bound and tagged with twist tie labeling article 84.

Figure 14A:
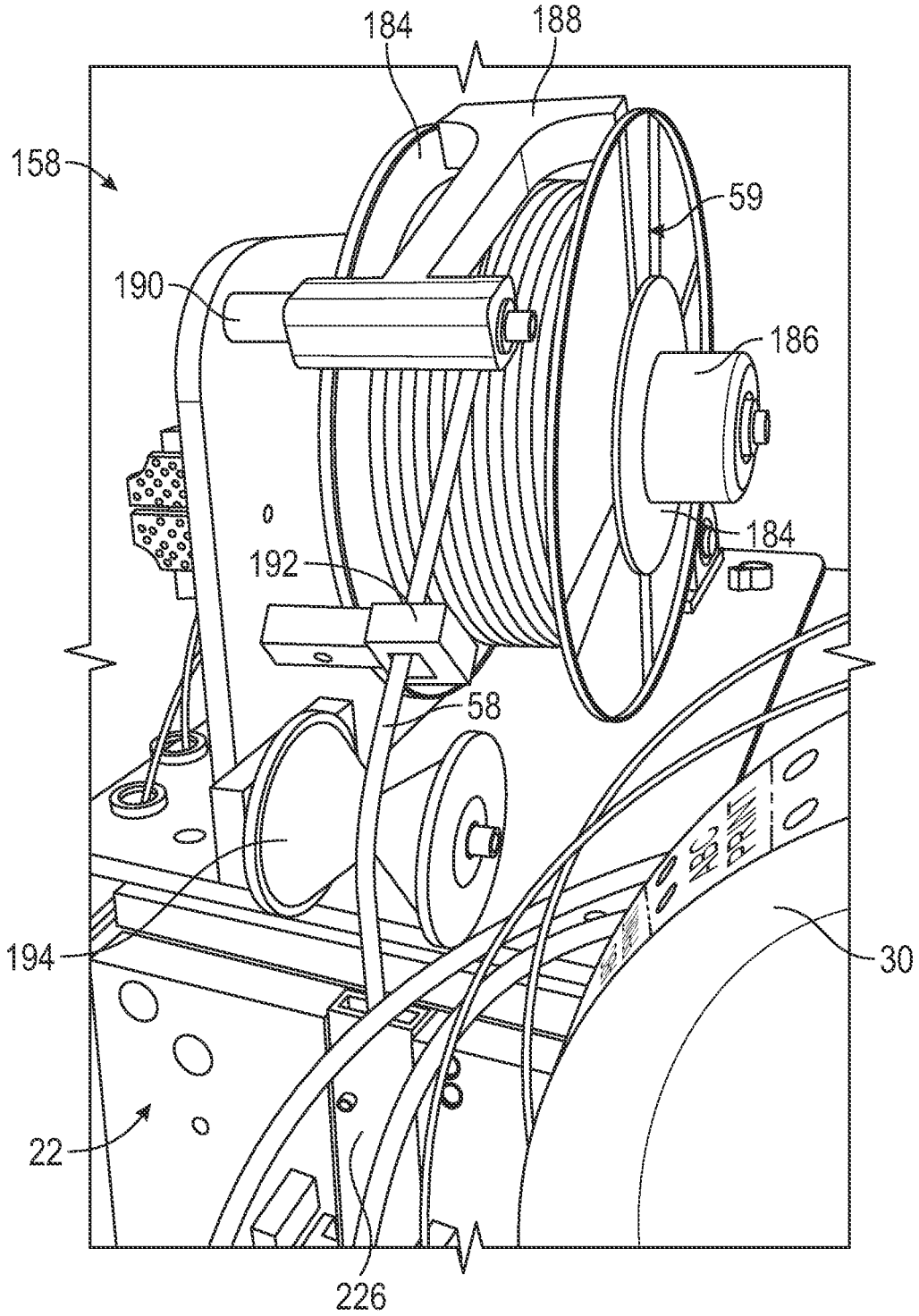
FIG. 14A is a front perspective view of a spool of twist tie material.
Figure 14B:
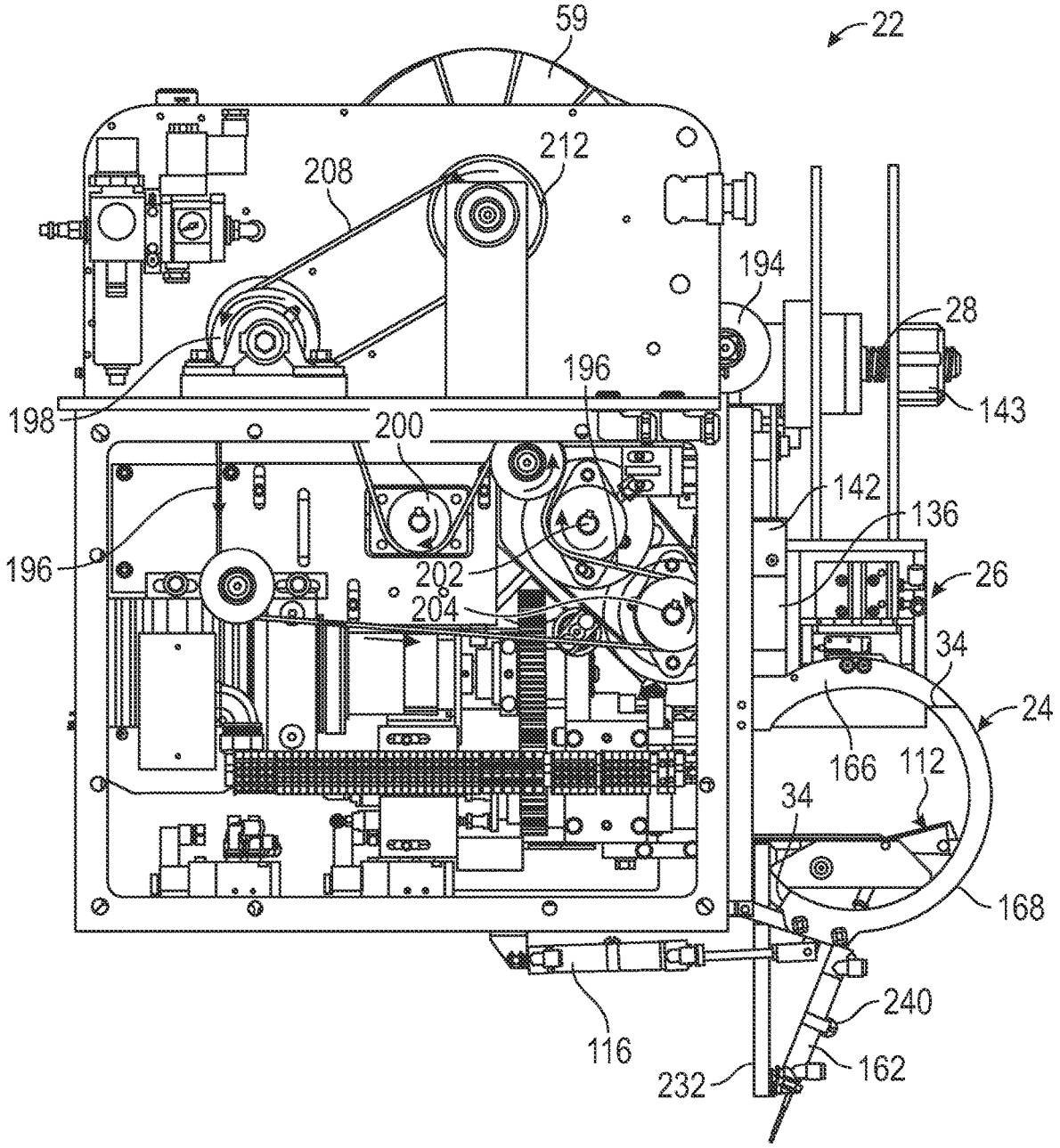
FIG. 14B is a left side elevation view of an exemplary tying machine, showing interior components of the mechanical cabinet for controlling twist tie payout, feeding and retraction.
Figure 14C:
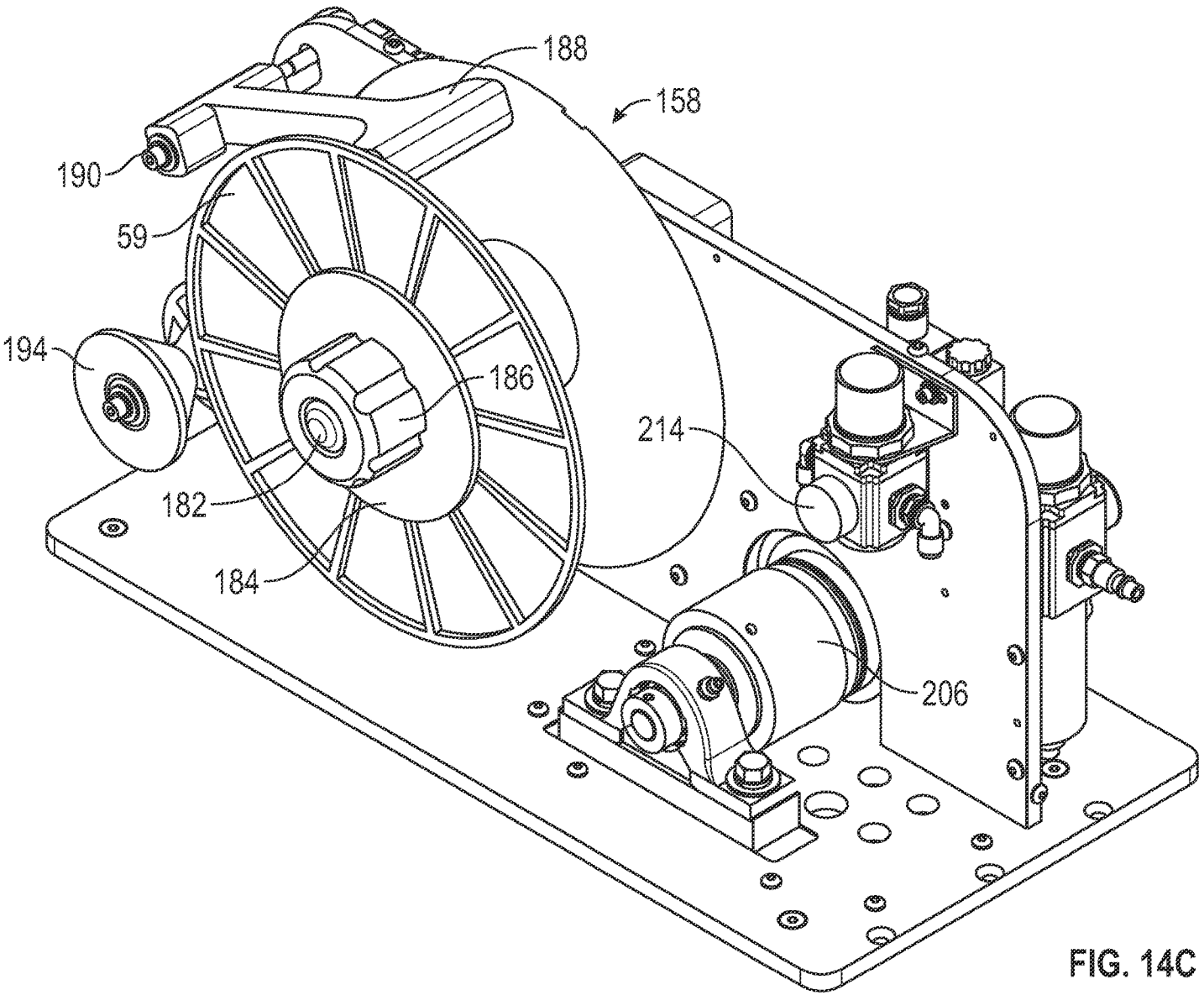
FIG. 14C is a right perspective view of an upper part of the exemplary tying machine, above the mechanical cabinet.
Figure 14D:
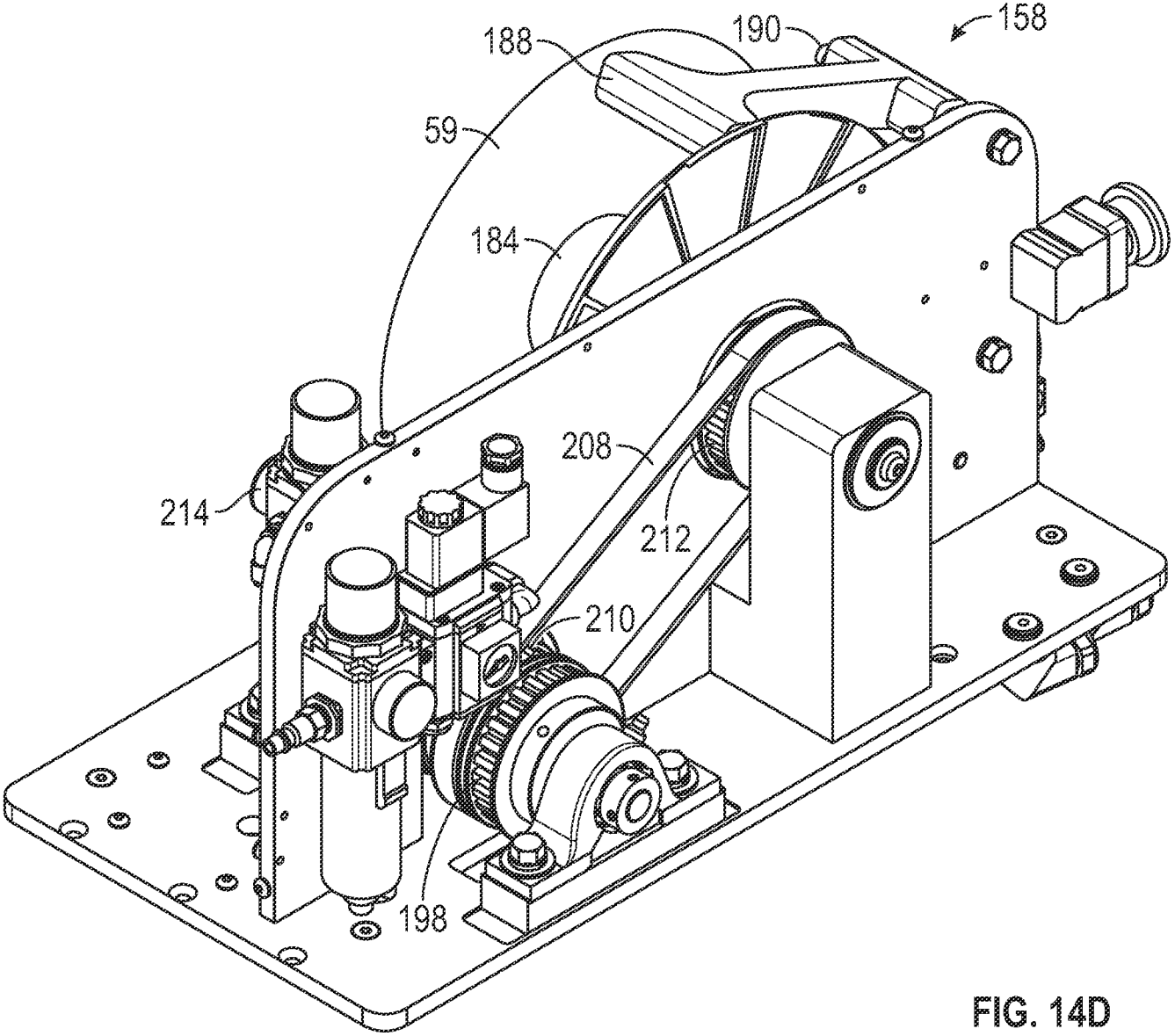
FIG. 14D is a left perspective view of an upper part of the exemplary tying machine, above the mechanical cabinet.

FIG. 14A is a front perspective view of a twist tie payout assembly 158 including spool 59 of twist tie material 58. As shown in FIG. 14C, spool 59 is supported on shaft 182. Flange 184 of spool 59 can be welded onto shaft 182 to positively fix motion of the spool 59 to that of shaft 182. Moreover, threaded nut 186 can be used to positively fix motion of the spool 59 to that of shaft 182. As shown in FIG. 14A, spool hold down arm 188 is pivotally mounted to pivot shaft 190 to prevent twist tie 58 from coming out of the spool flanges 184 when the spool 59 is reversed to take up excess twist tie length. Twist tie 58 from spool 59 is fed through top guide 192, which centers the twist tie 58 from and to the spool 59. Tie twist tie 58 then passes over a tie payout infeed roller 194 and into the tying machine 22.

FIG. 14B is a side elevation view of tying machine 22, showing interior components of the mechanical cabinet 176 for controlling twist tie payout, feeding and retraction. A double sided main tie drive timing belt 196 connects tie pulley 198, main drive pulley 200, forward feedroll shaft 202 and reverse feedroll shaft 204. Main drive belt 196 (not shown in FIG. 14D so that the structure of tie pulley 198 is visible) constantly runs during the tie payout and feeding operation. The running of main drive belt 196 causes tie pulley 198 to be constantly driven by the main drive pulley 200. When tie payout clutch 206 is activated, the clutch 206 engages tie pulley 198 and clutched tie payout pulley 210. Spool belt 208 connects clutched tie payout pulley 210 and keyed spool pulley 212. Spool shaft 182 is driven by keyed pulley 212. Thus, when tie payout clutch 206 is activated, the spool 59, connected to clutched tie payout pulley 210 by spool belt 208, turns in the illustrated counterclockwise direction in FIG. 14E, thereby taking up excess slack in twist tie 158. When payout clutch 206 is not activated, pulleys 210, 212 are idle.

Figure 14E:
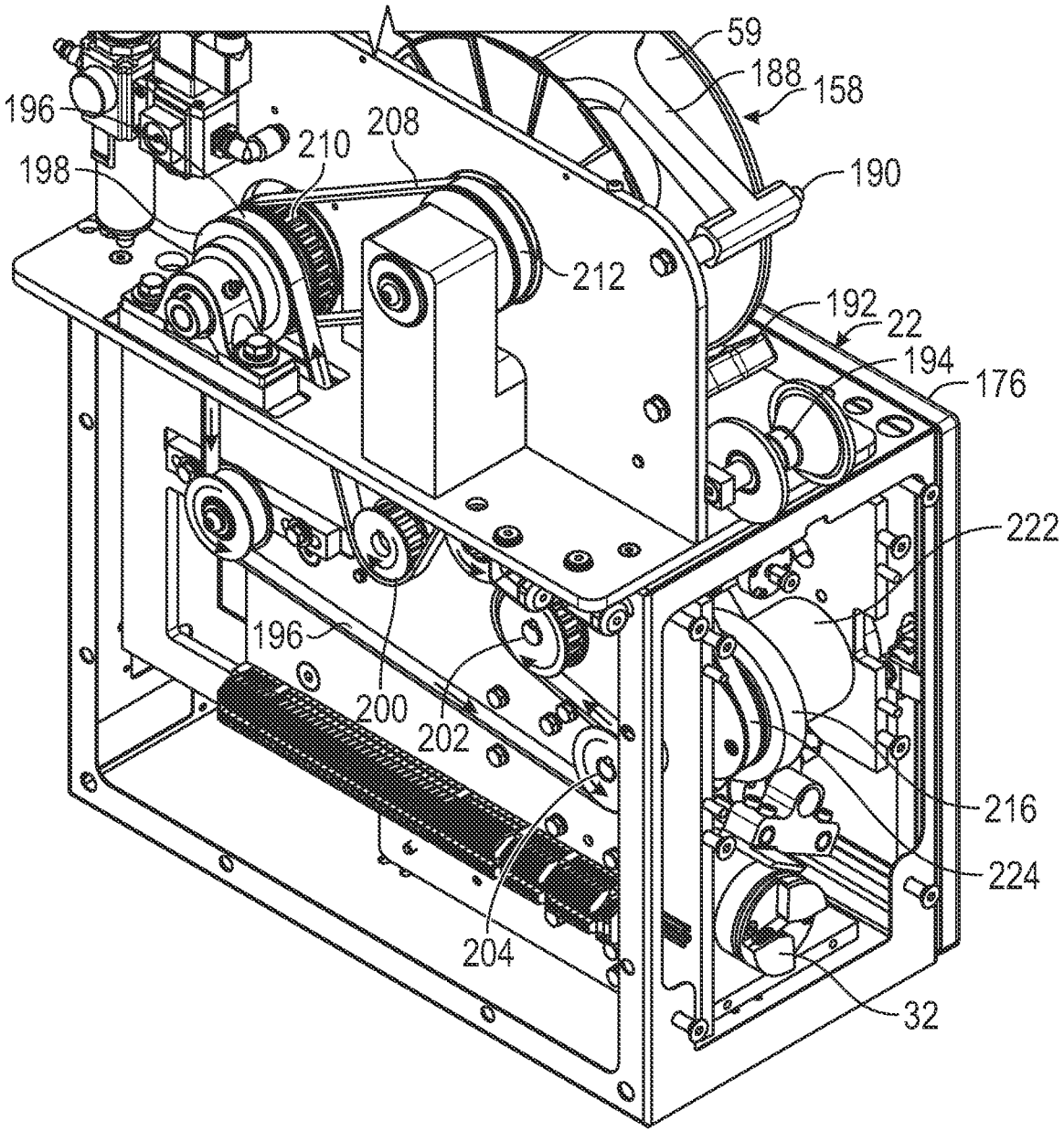
FIG. 14E is a left front perspective view of the exemplary tying machine, showing interior components of the mechanical cabinet
Figure 14F:
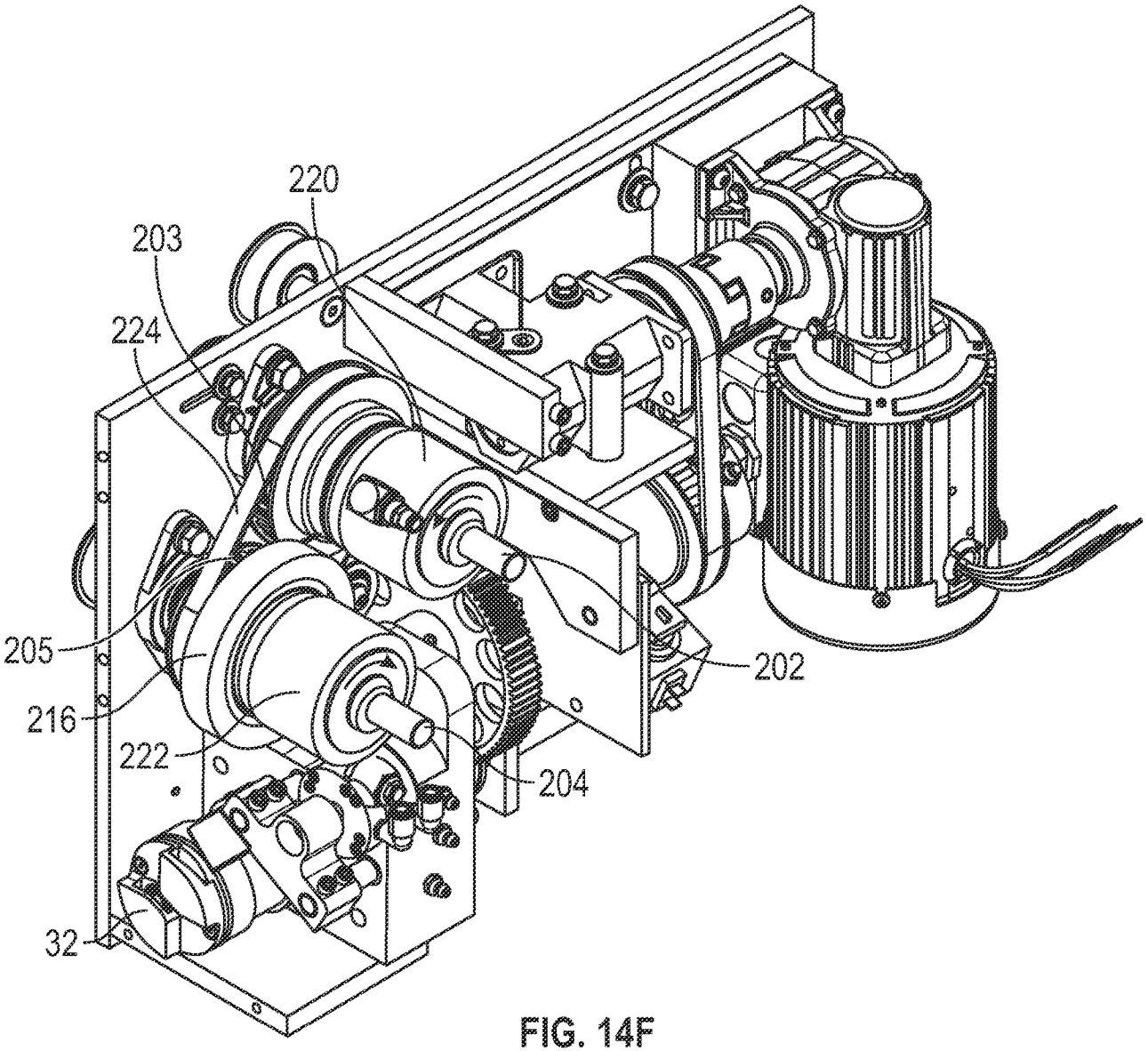
FIG. 14F is a right front perspective view of the opposite side of the tie feed roll area of the system, compared to FIG. 14E.

FIGS. 14B, 14E and 14F show interior components of a lower portion of mechanical cabinet 176. As the main drive belt 196 is constantly driven by main drive pulley 200, the indicated belt motion direction turns forward feedroll shaft 202 and the reverse feedroll shaft 204 in opposite rotational directions. As shown in FIG. 14F, forward feedroll pulley 203 of forward feedroll clutch 220 and reverse feedroll pulley 205 of reverse feedroll clutch 222 are connected by belt 224. When forward feedroll clutch 220 is engaged, feedroller 216 spins with forward shaft 202, thereby moving a twist tie 58 pressed against the feedroller 216 by nip roller 218 (shown in FIGS. 14G and 14H) downward to feed through twist barrel 32 and into tying ring 24. When reverse feedroll clutch 220 is engaged, feedroller 216 spins with reverse shaft 204, thereby moving a twist tie 58 pressed against the feedroller 216 by nip roller 218 upward to send the twist tie 58 back to spool 59. In an exemplary embodiment, reverse feedroll clutch 220 is an air clutch and is operatively connected to regulator 214 (labeled in FIGS. 14C and 14D).

In the described tie payout system 158 and tie feeding system, the reverse capabilities of spool 59 and feedroller 216 allow for excess twist tie 58 (such as resulting from the cinching of twist tie 58 about the product 36 by twist barrel 32) to be neatly fed back to the spool 59. Thus, the extra twist tie 58 is properly aligned for the next tagging and banding cycle of the system 20. Moreover, tying machine 22 and especially mechanical cabinet 176 can be compact, as no dancer roller is used to manage the position of extra twist tie material.

Figure 14G:
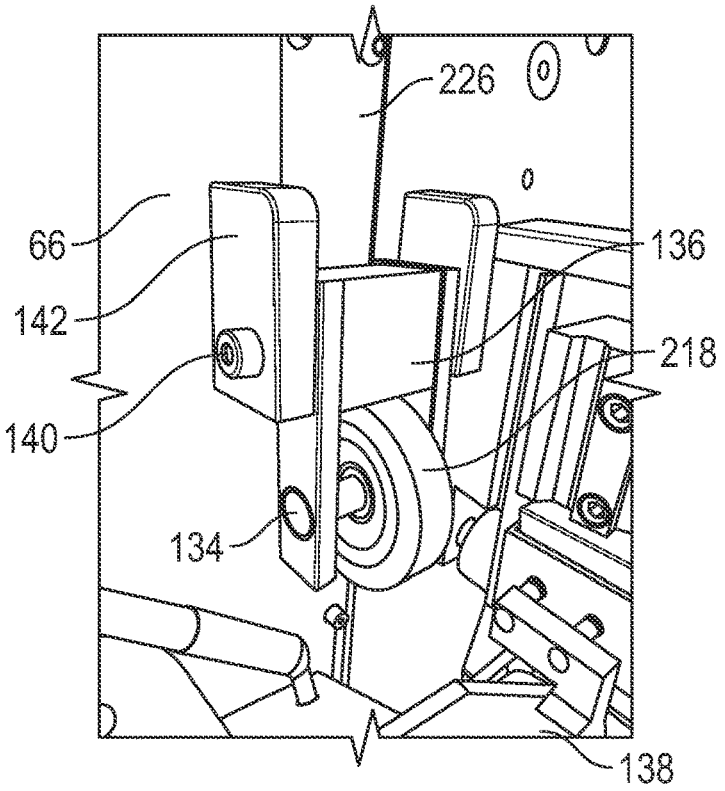
FIG. 14G is a front perspective view of a tie nip roller in a disengaged configuration.
Figure 14H:
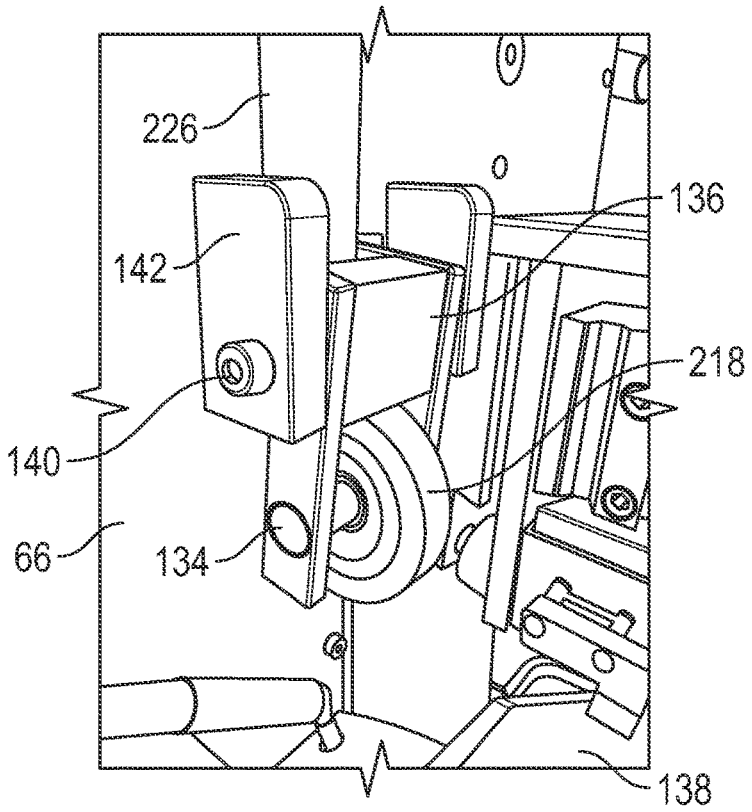
FIG. 14H is a front perspective view of a tie nip roller in an engaged configuration.

While not shown in FIG. 14E, it is to be understood that a twist tie 58 is disposed over tie payout infeed roller 194 and through tie guide 226 (labeled in FIGS. 14G and 14H) across a front face of feedroller 216 on its path to twist barrel 32. An opening is provided at plate 66 so that nip roller 218 can contact feedroller 216 with twist tie 58 pressed therebetween. Referring to FIGS. 14G and 14H, in an exemplary embodiment, nip roller 218 rolls on axle 134 of frame 136, which is attached to plate 66 with bracket 142 at pivot pin 140. FIG. 14G shows nip roller 218 in a disengaged configuration, and FIG. 14H shows nip roller 218 pivoted back toward feedroller 216 (not visible in this drawing, but labeled in FIGS. 14E and 14F) in an engaged configuration.

FIGS. 1A-1C, 10 and 15A-15D show a three-position dump table 112 operated by a single actuator 162. FIGS. 1A-1C and 10 show a flat, neutral, or "resting" position of table 112, wherein packings fingers 160 are interleaved with dump fingers 228 of tray 164, thereby presenting a substantially horizontal, continuous top surface for the receipt of a product 36. Cylinder 162 is disposed with a bottom pivotal connection 230 with strut 232 and a top pivotal connection 234 with link 236 (visible in FIGS. 15B and 15D). Pneumatic cylinder 162 is connected to link 236 on a packing finger 160, and the pneumatic cylinder 162 is fully extended in FIGS. 15A and 15B to push the packing fingers 160 to the illustrated "gathering" configuration.

Figure 15A:
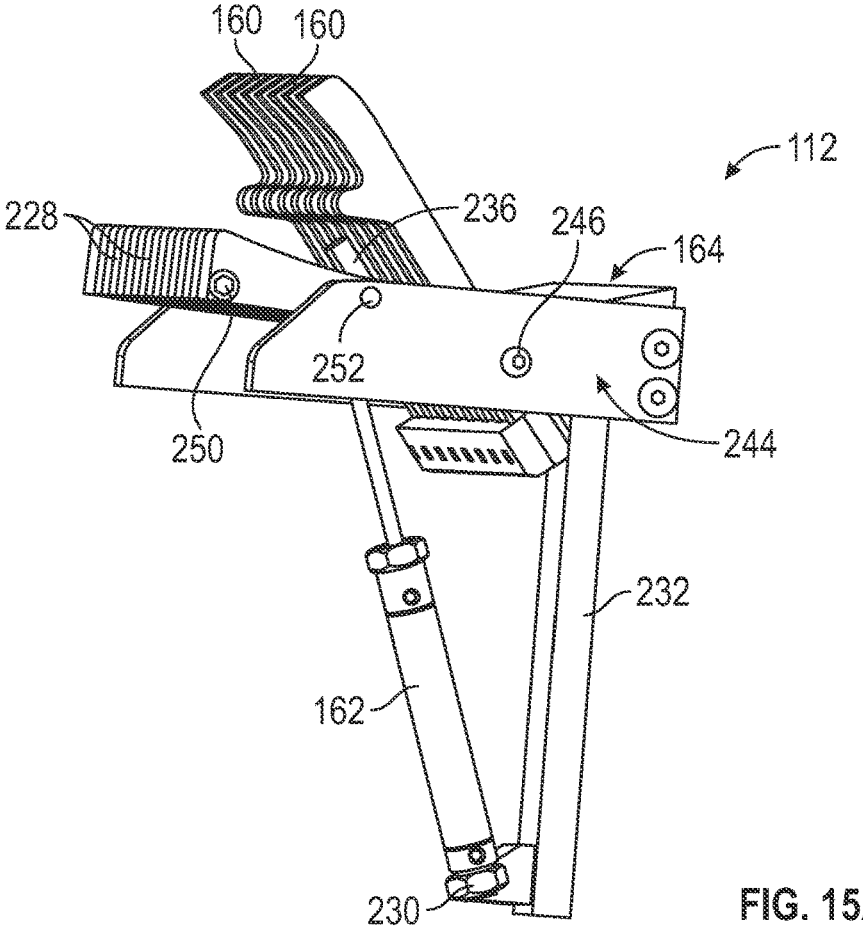
FIG. 15A is a side perspective view of the dump table with it packing fingers raised in a product bundling configuration; the pneumatic cylinder is fully extended to push the packing fingers to the illustrated configuration.
Figure 15B:
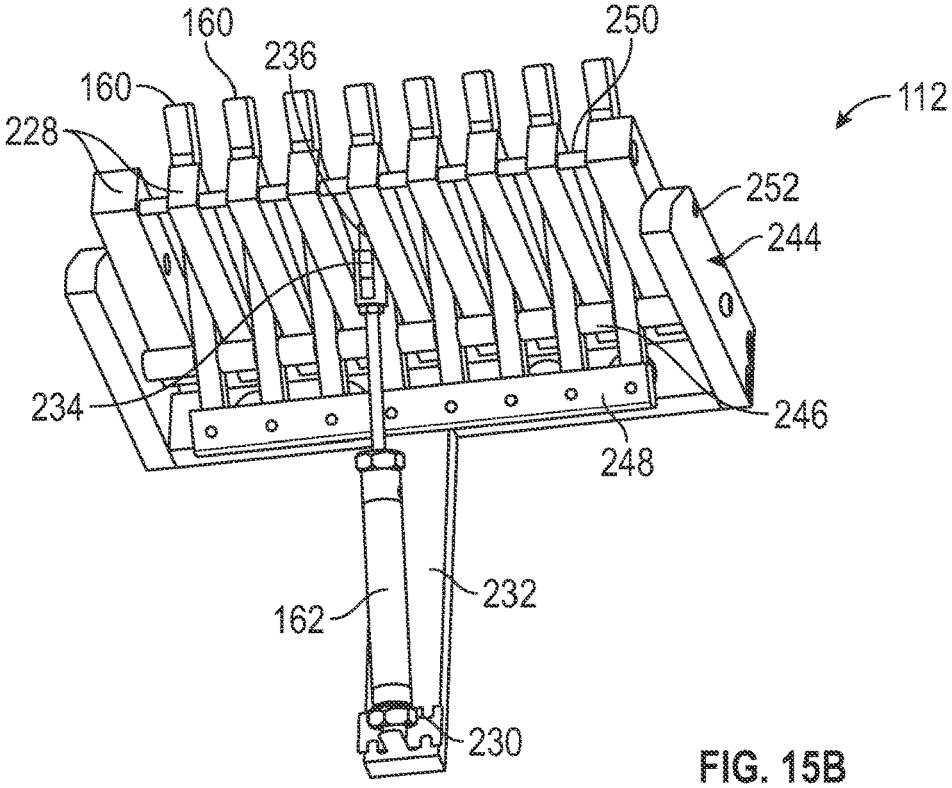
FIG. 15B is a bottom perspective view of the dump table in the configuration of FIG. 15A.
Figure 15C:
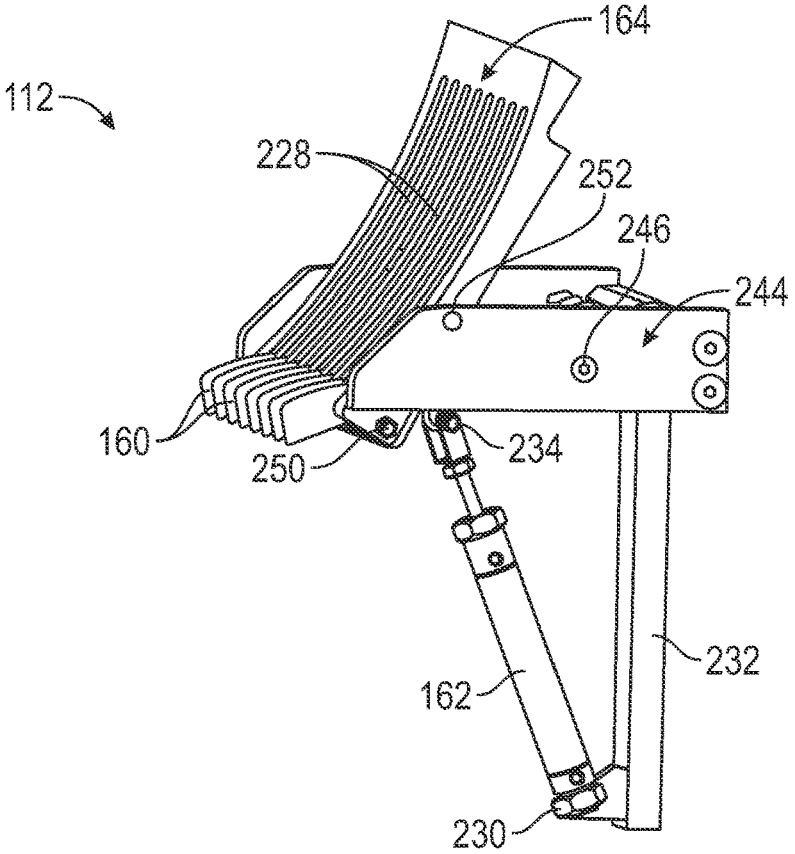
FIG. 15C is a side perspective view of a dump table with its tray in a raised, product releasing configuration.
Figure 15D:
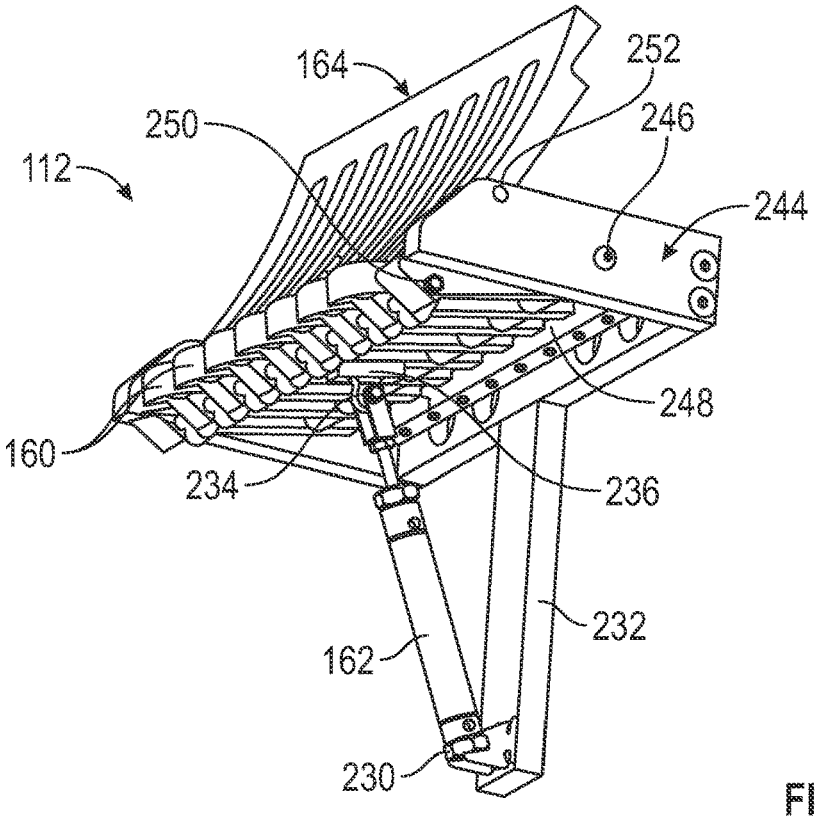
FIG. 15D is a bottom perspective view of the dump table in the configuration of FIG. 15C.

In an exemplary embodiment, cylinder 162 is controlled by a three position valve. A pneumatic cylinder piston sensor 240 (labeled in FIGS. 2A-6B) detects the piston portion of cylinder 162. In position "1," cylinder 162 is fully extended, so that packing fingers 160 are raised, as shown in FIGS. 15A and 15B. In position "2," cylinder 162 is fully retracted, so that dump tray 164 is raised, as shown in FIGS. 15C and 15D. To achieve the "centered" configuration of FIGS. 1A-1C and 10, the programmable logic controller (PLC) 242 actuates the valve until cylinder position sensor 240 detects a designated portion (such as the end) of the piston rod; at this point, PLC 242 locks the valve and therefore the extension of cylinder 162 in an intermediate position, wherein both packing fingers 160 and dump tray 164 are substantially horizontal.

FIGS. 15A-15D show exemplary structural connections of components of dump table 112. In an exemplary embodiment, frame 244 includes rear pivot shaft 246 disposed toward a rear of the frame 244. Pivot shaft 246 passes through each of the plurality of packing fingers 160. A rear end of each of the packing fingers is attached to bar 248, which constrains motion of the packing fingers 160, so that they move as a unit. Link 236 is attached to a packing finger 160 near the middle of the set and forward of pivot shaft 246.

Thus, full extension of cylinder 162 pushes upward on a central packing finger 160, thereby causing a front portion of all the connected packing fingers 160 to lift, as shown in FIGS. 15A and 15B.

In an exemplary embodiment, forward rod 250 passes through the front ends of each of the dump fingers 228 of tray 164. As shown in FIG. 15B, each of the packing fingers 160 is configured to rest above the front rod 250 in the flat configuration of dump table 112. When cylinder 162 is fully retracted, as in FIGS. 15C and 15D, the packing fingers 160 are pulled down so that they press downward on front rod 250, thereby causing the front end of tray 164 to lower and consequently the back end of tray 164 to lift, wherein tray 164 pivots relative to frame 244 and pivot pins 252.

An advantage of the disclosed system 20 is that an appropriate length of twist tie 58 is used for each product 36. Thus, smaller products will use a shorter length of twist tie 58, and larger (in diameter, for example) products will use an appropriately longer length of twist tie 58 to circumscribe the product and accommodate a secure twisted closure 86. Thus, twist tie 58 is used efficiently with no waste, compared to other tying methods that use pre-cut lengths of tie material.

This disclosure describes system 20 that uses machine 22 to automate the simultaneous banding and tagging of product 36 (such as merchandise) with a twist tie labeling article 84. The twist tie article 84 comprises an elongated twist tie 58 for banding about product 36 and a tag 42 for labeling the product 36. Tag 42 has an information portion 44 for displaying indicia 56 thereon and an attachment portion 46 for attaching the twist tie 58. In an exemplary embodiment, the tag 42 comprises a single continuous panel of water resistant sheet material that is initially separate from the twist tie 58. In exemplary embodiments, labeling article 84 is strong enough to withstand the rigors of transport and handling, and retain itself in position on the product 36, without damage to labeling article 84 or product 36.

Figure 16:
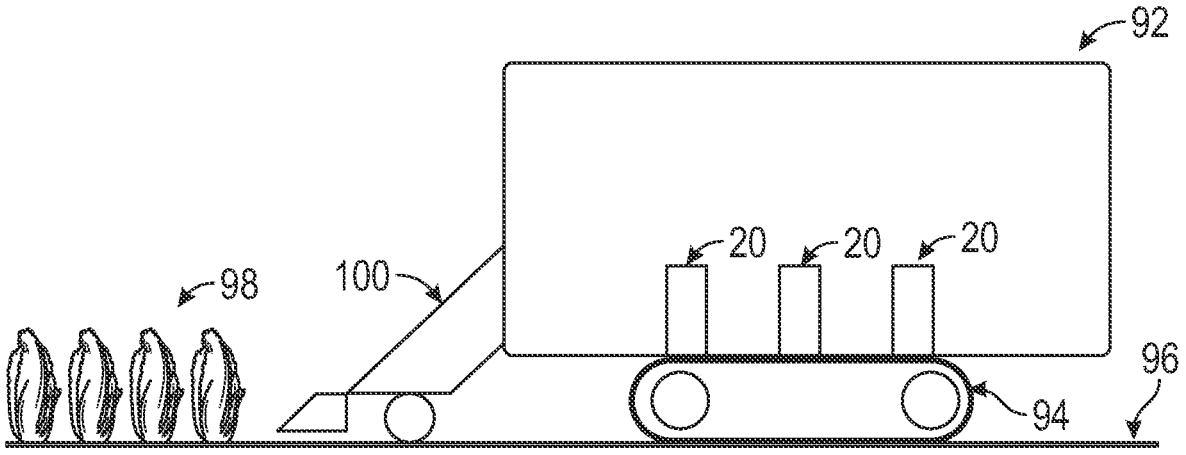
FIG. 16 is a side schematic elevation view of an exemplary mobile agricultural apparatus.

FIG. 16 is a side elevation view of an exemplary mobile agricultural apparatus 92, such as a harvesting platform, for example. One of the most efficient environments for banding and tagging produce is in the agricultural field relatively soon after the produce is harvested (but usually prior to any significant processing of the produce). The task of banding and tagging the produce in the agricultural field typically falls upon agricultural field workers. A field worker may perform this task hundreds of times each day and is typically paid on the basis of total daily output (and not on the basis of the time spent performing these tasks). As a result, the field workers strongly favor techniques of banding and tagging articles that are quick and simple to apply to produce (and they may resist or refuse techniques that require excessive time or effort). An exemplary harvesting platform apparatus 92 includes a ground engaging mechanism 94 such as a track or wheels for traveling over a field ground surface 96. The mobile apparatus 92 includes a plurality of automated systems 20 for applying twist tie labeling articles 84 to crop merchandise in the field.

In an exemplary method, agricultural product 98 is processed by harvester 100. A worker on the platform apparatus 92 prepares the product if necessary before insertion of a portion of the product into ring 24 of system 20. Such preparation may include aligning several stalks of the product in a bundle and cutting off an end of the bundle, for example. In some embodiments of system 20, product shelf 110 is provided to assist a worker in placing product 36 so that a portion thereof extends across the open space 25 of ring 24. Shelf 110 can be especially helpful when a plurality of products are to be gathered into a bundle. The appropriate number or size of items can be collected on shelf 110 until the target size of a bundle is ready for banding and tagging. Moreover, the user may provide an end marking 130 on shelf 110, as shown in FIG. 1B. Thus, the user has a visual indication of where to position an end of a bundle or merchandise item. This facilitates uniformity in the position of article 84 along a length of a merchandise product or item 36. Such uniformity is often desirable for ease of handling and pleasing display aesthetics of the tagged and banded merchandise.

Preparation steps will vary depending on the specific product. The worker inserts a portion of the product 36 into the ring 24 and actuates the automated tagging and labeling function of the machine to secure a twist tie labeling article 84 around the product. In an exemplary embodiment, mobile apparatus 92 is self-powered, and systems 20 are connected to the power source of apparatus 92. In other embodiments, systems 20 can be located on a trailer traveling along with harvesting or other agricultural equipment. While some descriptions refer to an agricultural platform, system 20 can be used in other environments, such as in automation equipment for industrial use, such as with robotics, conveyors or other higher automation functions, such as for combining parts or bundling items together. Suitable items for receiving twist tie labeling articles 84 include elongated items like pipes, rods or tubing, and items to be banded together, such as components of kits, for example.

Although the subject of this disclosure has been described with reference to several embodiments, workers skilled in the art will recognize that changes may be made in form and detail without departing from the scope of the disclosure. In addition, any feature disclosed with respect to one embodiment may be incorporated in another embodiment, and vice-versa.

The invention claimed is:

1. A system configured to automatically band a product with a portion of twist tie material, the system comprising:

a tying machine comprising:

a twisting barrel;

a tie payout assembly comprising a spool shaft configured for mounting a tie spool of the twist tie material;

a tie feeding assembly configured to receive the twist tie material from the tie payout assembly, the tie feeding assembly comprising:

a feedroller;

a nip roller configured to contact the feedroller with the twist tie material therebetween;

a forward feedroll clutch engageable with a forward feedroll pulley that surrounds a forward feedroll shaft;

a reverse feedroll clutch engageable with a reverse feedroll pulley that surrounds a reverse feedroll shaft; and a feedroll belt operatively connected to the forward feedroll pulley and the reverse feedroll pulley;

wherein engagement of the forward feedroll clutch rotates the feedroller forward to move the twist tie material toward a tying ring; and wherein engagement of the reverse feedroll clutch rotates the feedroller backward to move the twist tie material toward the tie spool;

a main drive belt driven by a main drive pulley around the forward feedroll shaft and the reverse feedroll shaft; and the tying ring comprising a channel configured to convey the twist tie material from the twisting barrel, and back to the twisting barrel, thereby encircling the product.

2. The system of claim 1, wherein the tie payout assembly comprises a tie payout pulley operatively connected to the main drive belt.

3. The system of claim 2, comprising:

a tie payout clutch engageable with a tie payout pulley;

a spool pulley fixed to the spool shaft; and a spool belt operatively connected to the tie payout pulley and the spool pulley;

wherein engagement of the tie payout clutch couples motion of the tie payout pulley with the main drive belt.

4. The system of claim 1 comprising:

a tag feeding assembly configured to convey a strip of a plurality of ruptureably connected tags to a tag receiving portion of the tying ring.

5. The system of claim 4 wherein the tag feeding assembly comprises:

a track plate along which the strip is conveyed; and a clamp that is selectively actuable between:

a first position spaced from the strip; and a second position in contact with the strip.

6. The system of claim 4 comprising:

a tag supply support;

a tag spool mounted on the tag supply support, wherein the strip is wound on the tag spool;

a tag payout dancer arm pivotally mounted to the tag supply support;

a dancer roller pivotally mounted to the tag payout dancer arm; and a tension spring connecting the tag payout dancer arm and the tag supply support;

wherein the strip is configured to travel from the tag spool, around the dancer roller, and to the tag feeding assembly.

7. The system of claim 1 wherein the tying machine comprises:

a mechanical cabinet housing the twisting barrel, the tie payout assembly, the tie feeding assembly, the main drive belt, and the tying ring; and an electrical cabinet.

8. The system of claim 7 wherein the mechanical cabinet is adjustable mounted on a mobile frame.

9. The system of claim 1 comprising a table configured for receipt of the product, wherein the product placed on the table is configured to extend into an annulus of the tying ring.

10. The system of claim 9 wherein the table is movable between:

a first horizontal position; and a second raised position.

* * * * *